US010679814B2

(12) United States Patent
Vrhunc et al.

(10) Patent No.: US 10,679,814 B2
(45) **Date of Patent: *Jun. 9, 2020**

(54) SURGE PROTECTIVE DEVICE MODULES INCLUDING INTEGRAL THERMAL DISCONNECT MECHANISMS AND METHODS INCLUDING SAME

(71) Applicant: RAYCAP IP DEVELOPMENT LTD, Nicosia (CY)

(72) Inventors: Jure Vrhunc, Ljubljana (SI); Sebastjan Kamenšek, Škofja Loka (SI); Tadej Knez, Grosuplje (SI); Igor Juričev, Izola (SI); Thomas Tsovilis, Ljubljana (SI)

(73) Assignee: RAYCAP IP DEVELOPMENT LTD, Nicosia (CY)

( * ) Notice: Subject to any disclaimer, the term of this patent is extended or adjusted under 35 U.S.C. 154(b) by 0 days.

This patent is subject to a terminal disclaimer.

(21) Appl. No.: 16/411,995

(22) Filed: May 14, 2019

(65) Prior Publication Data

US 2019/0267206 A1 Aug. 29, 2019

Related U.S. Application Data

(63) Continuation of application No. 15/593,591, filed on May 12, 2017, now Pat. No. 10,340,110.

(51) Int. Cl.
*H01H 85/02* (2006.01)
*H01C 7/12* (2006.01)
(Continued)

(52) U.S. Cl.
CPC ..... *H01H 85/0241* (2013.01); *H01C 7/126* (2013.01); *H01H 37/761* (2013.01);
(Continued)

(58) Field of Classification Search
CPC ..... H01C 7/126; H01H 37/761; H01H 2037/762; H01H 2037/763;
(Continued)

(56) References Cited

U.S. PATENT DOCUMENTS 1,144,029 A 6/1915 Creighton
2,158,859 A 5/1939 Horikoshi
(Continued)

FOREIGN PATENT DOCUMENTS

CH 466427 12/1968
DE 3111096 A1 9/1982
(Continued)

OTHER PUBLICATIONS

Beitz et al. "Dubbel Taschenbuch für den Maschinenbau" (3 pages) (1997).
(Continued)

*Primary Examiner* — Jacob R Crum
(74) *Attorney, Agent, or Firm* — Myers Bigel, P.A.

(57) ABSTRACT

A surge protective device (SPD) module includes a module housing, first and second module electrical terminals mounted on the module housing, an overvoltage clamping element electrically connected between the first and second module electrical terminals, and a thermal disconnector mechanism. The thermal disconnector mechanism is positioned in a ready configuration, wherein the overvoltage clamping element is electrically connected with the second module electrical terminal. The thermal disconnector mechanism is repositionable to electrically disconnect the overvoltage clamping element from the second module electrical terminal. The thermal disconnector mechanism includes: an electrode electrically connected to the overvoltage clamping element; a disconnect spring elastically deflected and electrically connected to the electrode in the
(Continued)

ready configuration; a solder securing the disconnect spring in electrical connection with the electrode in the ready configuration; and a heat sink member thermally interposed between the electrode and the solder, the heat sink member having a thermal capacity. The solder is meltable in response to overheating of the overvoltage clamping element. The disconnect spring is configured to electrically disconnect the overvoltage clamping element from the second module electrical terminal when the solder is melted. The thermal capacity of the heat sink member buffers and dissipates heat from the overvoltage clamping element to prevent the solder from melting in response to at least some surge currents through the SPD module.

19 Claims, 18 Drawing Sheets

(51) Int. Cl.
*H01H 37/76* (2006.01)
*H01H 85/04* (2006.01)
*H01H 85/20* (2006.01)
*H01H 85/47* (2006.01)

(52) U.S. Cl.
CPC ..... *H01H 85/04* (2013.01); *H01H 85/20* (2013.01); *H01H 85/47* (2013.01); *H01H 2037/762* (2013.01)

(58) Field of Classification Search
CPC .... H01H 85/0241; H01H 85/04; H01H 85/06; H01H 85/08; H01H 85/20; H01H 85/47
See application file for complete search history.

(56) References Cited

U.S. PATENT DOCUMENTS 2,311,758 A 2/1943 Johansson
2,971,132 A 2/1961 Nash
3,249,719 A 5/1966 Misare et al.
3,375,405 A 3/1968 Fallon et al.
3,522,570 A 8/1970 Wanaselja
3,711,794 A 1/1973 Tasca et al.
3,743,996 A 7/1973 Harnden
3,813,577 A 5/1974 Kawiecke
4,015,228 A 3/1977 Eda et al.
4,023,133 A 5/1977 Knapp, Jr.
4,085,397 A 4/1978 Yagher, Jr.
4,092,694 A 5/1978 Stetson
4,217,618 A 8/1980 Boney et al.
4,240,124 A 12/1980 Westrom
4,241,374 A 12/1980 Gilberts
4,249,224 A 2/1981 Baumbach
4,288,833 A 9/1981 Howell
4,355,345 A 10/1982 Franchet
4,425,017 A 1/1984 Chan
4,493,003 A 1/1985 Mickelson et al.
4,571,656 A 2/1986 Ruckman
4,595,635 A 6/1986 Dubrow et al.
4,600,261 A 7/1986 Debbaut
4,638,284 A 1/1987 Levinson
4,701,574 A 10/1987 Shimirak et al.
4,906,963 A 3/1990 Ackermann et al.
4,908,730 A 3/1990 Westrom
4,956,696 A 9/1990 Hoppe et al.
5,006,950 A 4/1991 Allina
5,130,884 A 7/1992 Allina
5,172,296 A 12/1992 Kaczmarek
5,311,164 A 5/1994 Ikeda et al.
5,519,564 A 5/1996 Carpenter, Jr.
5,523,916 A 6/1996 Kaczmarek
5,529,508 A 6/1996 Chiotis et al.
5,588,856 A 12/1996 Collins et al.
5,621,599 A 4/1997 Larsen et al.
5,652,690 A 7/1997 Mansfield et al.
5,721,664 A 2/1998 Uken et al.
5,724,221 A 3/1998 Law
5,781,394 A 7/1998 Lorenz et al.
5,808,850 A 9/1998 Carpenter, Jr.
5,936,824 A 8/1999 Carpenter, Jr.
5,990,778 A 11/1999 Struempler et al.
6,038,119 A 3/2000 Atkins et al.
6,094,128 A 7/2000 Bennett et al.
6,172,865 B1 1/2001 Boy et al.
6,175,480 B1 1/2001 Karmazyn
6,222,433 B1 4/2001 Ramakrishnan et al.
6,226,166 B1 5/2001 Gumley et al.
6,430,019 B1 8/2002 Martenson et al.
6,430,020 B1 8/2002 Atkins et al.
6,459,559 B1 10/2002 Christofersen
6,556,402 B2 4/2003 Kizis et al.
6,614,640 B2 9/2003 Richter et al.
6,930,871 B2 8/2005 Macanda
7,433,169 B2 10/2008 Kamel et al.
7,558,041 B2 7/2009 Lagnoux
7,684,166 B2 3/2010 Donati et al.
7,738,231 B2 6/2010 Lagnoux
8,493,170 B2 7/2013 Zaeuner et al.
8,659,866 B2 2/2014 Douglass et al.
8,743,525 B2 6/2014 Xepapas et al.
9,349,548 B2 5/2016 Juricev
9,355,763 B2 5/2016 Xu
9,570,260 B2 2/2017 Yang et al.
9,634,554 B2 4/2017 Falk et al.
9,906,017 B2 2/2018 Tsovilis et al.
2002/0018331 A1 2/2002 Takahashi
2002/0024792 A1 2/2002 Cantagrel
2003/0184926 A1 10/2003 Wu et al.
2004/0150937 A1 8/2004 Bobert et al.
2005/0231872 A1 10/2005 Schimanski et al.
2006/0245125 A1 11/2006 Aszmus
2006/0291127 A1 12/2006 Kim et al.
2007/0217106 A1 9/2007 Lagnoux
2008/0043395 A1 2/2008 Donati et al.
2008/0049370 A1 2/2008 Adachi et al.
2009/0302992 A1 12/2009 Cernicka
2011/0193674 A1 8/2011 Zaeuner et al.
2011/0248816 A1 10/2011 Duval et al.
2012/0050935 A1 3/2012 Douglass et al.
2012/0086539 A1 4/2012 Duval et al.
2012/0086540 A1 4/2012 Duval et al.
2012/0206848 A1 8/2012 Gillespie et al.
2012/0250205 A1 10/2012 Pfitzer et al.
2013/0038976 A1 2/2013 Hagerty
2013/0200986 A1 8/2013 Koprivsek
2013/0265685 A1 10/2013 Zäuner et al.
2013/0335869 A1 12/2013 Xepapas et al.
2014/0010704 A1 1/2014 Ishida et al.
2014/0092514 A1 4/2014 Chen
2014/0292472 A1* 10/2014 Qin ..... H01H 85/306 337/5
2014/0327990 A1 11/2014 Juricev
2015/0103462 A1 4/2015 Depping
2015/0107972 A1 4/2015 Oh
2015/0270086 A1 9/2015 Chen
2015/0280420 A1 10/2015 Mao
2015/0349523 A1 12/2015 Tsovilis et al.
2016/0087520 A1 3/2016 Falk et al.
2016/0276821 A1 9/2016 Politis et al.
2017/0311462 A1 10/2017 Kamensek et al.
2018/0138698 A1 5/2018 Tsovilis et al.
2018/0151318 A1 5/2018 Kamensek et al.
2018/0183230 A1 6/2018 Kostakis et al.
2018/0183232 A1 6/2018 Tavcar et al.
2019/0080826 A1 3/2019 Kamensek et al.

FOREIGN PATENT DOCUMENTS

DE 3428258 2/1986
DE 4235329 4/1994
DE 69201021 T2 5/1995
DE 4438593 5/1996

(56) References Cited

FOREIGN PATENT DOCUMENTS

| | | | |
|---|---|---|---|
| DE | 19823446 | | 11/1999 |
| DE | 19839422 | | 3/2000 |
| DE | 19843519 | | 4/2000 |
| DE | 202004006227 | | 10/2004 |
| DE | 10323220 | | 12/2004 |
| DE | 102006003274 | | 1/2008 |
| DE | 202008004699 | | 6/2008 |
| DE | 102007014336 | | 10/2008 |
| DE | 102008017423 | | 10/2009 |
| DE | 102008026555 | | 12/2009 |
| DE | 102013021936 | | 2/2012 |
| DE | 102012004678 | | 9/2013 |
| DE | 202006021210 | | 9/2013 |
| DE | 102013103753 | | 10/2013 |
| DE | 102013011216 | | 10/2014 |
| DE | 102013107807 | | 1/2015 |
| DE | 102014016938 | | 2/2016 |
| DE | 102014016830 | | 9/2016 |
| DE | 102007030653 | B4 | 4/2017 |
| EP | 0108518 | | 5/1984 |
| EP | 0203737 | | 12/1986 |
| EP | 0335479 | | 10/1989 |
| EP | 0445054 | | 9/1991 |
| EP | 0462694 | | 12/1991 |
| EP | 0516416 | | 12/1992 |
| EP | 0603428 | | 6/1994 |
| EP | 0785625 | | 7/1997 |
| EP | 1094550 | | 4/2001 |
| EP | 1102371 | | 5/2001 |
| EP | 1116246 | | 7/2001 |
| EP | 1355327 | | 10/2003 |
| EP | 1458072 | | 9/2004 |
| EP | 0963590 | | 11/2004 |
| EP | 1798742 | | 6/2007 |
| EP | 2075811 | | 7/2009 |
| EP | 2707892 | | 3/2014 |
| EP | 2725588 | | 4/2014 |
| EP | 2953142 | A1 | 12/2015 |
| EP | 2954538 | B1 | 12/2015 |
| EP | 3001525 | | 3/2016 |
| EP | 3240132 | | 11/2017 |
| FR | 2574589 | | 6/1986 |
| FR | 2622047 | | 4/1989 |
| FR | 2897231 | | 8/2007 |
| JP | 60-187002 | | 9/1985 |
| JP | 60-226103 | | 11/1985 |
| JP | 60-258905 | | 12/1985 |
| JP | 61-198701 | | 9/1986 |
| JP | 1-176687 | | 7/1989 |
| JP | H05176445 | | 7/1993 |
| JP | 09-326546 | | 12/1997 |
| JP | 2002-525861 | | 8/2002 |
| JP | 2002-525862 | | 8/2002 |
| SI | 9700277 | | 4/1999 |
| SI | 9700332 | | 6/1999 |
| SI | 20781 | | 6/2002 |
| SI | 20782 | | 6/2002 |
| SI | 22030 | | 10/2006 |
| SI | 23303 | | 8/2011 |
| SI | 23749 | | 11/2012 |
| SI | 24371 | | 11/2014 |
| WO | 88/00603 | | 1/1988 |
| WO | 90/05401 | | 5/1990 |
| WO | 95/15600 | | 6/1995 |
| WO | 95/24756 | | 9/1995 |
| WO | 97/42693 | | 11/1997 |
| WO | 98/38653 | | 9/1998 |
| WO | 00/17892 | | 3/2000 |
| WO | 2007/117163 | | 10/2007 |
| WO | 2008/009507 | | 1/2008 |
| WO | 2008/104824 | | 9/2008 |
| WO | 2011/102811 | | 8/2011 |
| WO | 2012/026888 | | 3/2012 |
| WO | 2012/154134 | | 11/2012 |
| WO | 2013/044961 | | 4/2013 |
| WO | 2016/101776 | | 6/2016 |
| WO | 2016/110360 | | 7/2016 |

OTHER PUBLICATIONS

Data Book Library 1997 Passive Components, Siemens Matsushita Components pp. 15-17, 26-32, 36-37, 39, 161, 166, 167, 169, 171-174 (1997).

Extended European Search Report in corresponding European Application No. 17207945.1 (8 pages) (dated Aug. 10, 2018).

Oberg et al. "Machinery's Handbook 27th Edition—Soldering and Brazing" (4 pages) (2004).

Raycap "RayvossTM Transient Voltage Surge Suppression System" webpage, http://www.raycap.com/surge/rayvoss.htm accessed on Nov. 29, 2005 (1 page) (Date Unknown; Admitted Prior Art).

Raycap "Revolutionary Lightning Protection Technology" Raycap Corporation Press Release, webpage, http://www.raycap.com/news/020930.htm accessed on Nov. 29, 2005 (1 page) (Date Unknown; Admitted Prior Art).

Raycap "The Ultimate Overvoltage Protection: RayvossTM" brochure (4 pages) (Date Unknown; Admitted Prior Art).

Raycap "Strikesorb® 30 Series OEM Surge Suppression Solutions" brochure (2 pages) (Apr. 17, 2009).

Raycap "The Next Generation Surge Protection Rayvoss™" brochure (4 pages) (May 4, 2012).

Raycap "The Ultimate Overvoltage Protection Rayvoss™" brochure (4 pages) (2005).

Raycap "The Ultimate Overvoltage Protection Rayvoss™" brochure (4 pages) (Jan. 2009).

RayvossTM "The Ultimate Overvoltage Protection" webpage, http://www.rayvoss.com accessed on Nov. 29, 2005 (2 pages) (Date Unknown; Admitted Prior Art).

RayvossTM "Applications" webpage http://www.rayvoss.com/applications.htm accessed on Nov. 29, 2005 (4 pages) (undated).

RayvossTM "Frequently Asked Questions" webpage, http://www.rayvoss.com/faq.htm accessed on Nov. 29, 2005 (2 pages) (Date Unknown; Admitted Prior Art).

RayvossTM "Technical Information" webpage, http://www.rayvoss.com/tech_info.htm accessed on Nov. 29, 2005 (3 pages) (Date Unknown; Admitted Prior Art).

FormexTM GK/Formex Product Data Flame Retardant Polypropylene Sheet, ITW Formex (4 pages) (2002).

Translation of DIN-Standards, Built-In Equipment for Electrical Installations; Overall Dimensions and Related Mounting Dimensions (15 pages) (Dec. 1988).

VAL-MS-T1/T2 335/12.5/3+1, Extract from the online catalog, Phoenix Contact GmbH & Co. KG, http://catalog.phoenixcontact.net/phoenix/treeViewClick.do?UID=2800184 (7 pages) (May 22, 2014).

* cited by examiner

SURGE PROTECTIVE DEVICE MODULES INCLUDING INTEGRAL THERMAL DISCONNECT MECHANISMS AND METHODS INCLUDING SAME

RELATED APPLICATION(S)

The present application is a continuation application of and claims priority from U.S. patent application Ser. No. 15/593,591, filed May 12, 2017, the disclosure of which is incorporated herein by reference.

FIELD OF THE INVENTION

The present invention relates to surge protective devices and, more particularly, to surge protective devices including thermal disconnectors and alerting mechanisms.

BACKGROUND OF THE INVENTION

Frequently, excessive voltage or current is applied across service lines that deliver power to residences and commercial and institutional facilities. Such excess voltage or current spikes (transient overvoltages and surge currents) may result from lightning strikes, for example. The above events may be of particular concern in telecommunications distribution centers, hospitals and other facilities where equipment damage caused by overvoltages and/or current surges is not acceptable and resulting down time may be very costly.

Typically, sensitive electronic equipment may be protected against transient overvoltages and surge currents using surge protective devices (SPDs). For example, an overvoltage protection device may be installed at a power input of equipment to be protected, which is typically protected against overcurrents when it fails. Typical failure mode of an SPD is a short circuit. The overcurrent protection typically employed is a combination of an internal thermal disconnector to protect the device from overheating due to increased leakage currents and an external fuse to protect the device from higher fault currents. Different SPD technologies may avoid the use of the internal thermal disconnector because, in the event of failure, they change their operation mode to a low ohmic resistance.

In the event of a surge current in a line L (e.g., a voltage line of a three phase electrical power circuit), protection of power system load devices may necessitate providing a current path to ground for the excess current of the surge current. The surge current may generate a transient overvoltage between the line L and the neutral line N (the neutral line N may be conductively coupled to an earth ground PE). Since the transient overvoltage significantly exceeds the operating voltage of the SPD, the SPD will become conductive, allowing the excess current to flow from line L through SPD to the neutral N. Once the surge current has been conducted to neutral N, the overvoltage condition ends and the SPD may become non-conducting again. However, in some cases, one or more SPDs may begin to allow a leakage current to be conducted even at voltages that are lower that the operating voltage of the SPDs. Such conditions may occur in the case of an SPD deteriorating.

SUMMARY

According to embodiments of the invention, a surge protective device (SPD) module includes a module housing, first and second module electrical terminals mounted on the module housing, an overvoltage clamping element electrically connected between the first and second module electrical terminals, and a thermal disconnector mechanism. The thermal disconnector mechanism is positioned in a ready configuration, wherein the overvoltage clamping element is electrically connected with the second module electrical terminal. The thermal disconnector mechanism is repositionable to electrically disconnect the overvoltage clamping element from the second module electrical terminal. The thermal disconnector mechanism includes: an electrode electrically connected to the overvoltage clamping element; a disconnect spring elastically deflected and electrically connected to the electrode in the ready configuration; a solder securing the disconnect spring in electrical connection with the electrode in the ready configuration; and a heat sink member thermally interposed between the electrode and the solder, the heat sink member having a thermal capacity. The solder is meltable in response to overheating of the overvoltage clamping element. The disconnect spring is configured to electrically disconnect the overvoltage clamping element from the second module electrical terminal when the solder is melted. The thermal capacity of the heat sink member buffers and dissipates heat from the overvoltage clamping element to prevent the solder from melting in response to at least some surge currents through the SPD module.

In some embodiments, the thermal capacity of the heat sink member is in the range of from about 0.2 to 2.0 J/K.

In some embodiments, the thermal capacity of the heat sink member is at least about 0.15 times a thermal capacity of the electrode. In some embodiments, the overvoltage clamping element is a varistor.

According to some embodiments, the heat sink member is affixed to the electrode, and the solder directly engages the heat sink member. In some embodiments, the heat sink member is affixed to the electrode by rivets.

According to some embodiments, the electrode includes a base portion engaging the overvoltage clamping element, and an integral upstanding termination tab connecting the base portion to the heat sink member.

According to some embodiments, the SPD module includes a support frame, and the support frame includes an integral support feature configured to resist displacement of the heat sink member relative to the disconnect spring.

In some embodiments, the SPD module includes a supplemental spring. In the ready configuration, the supplemental spring is electrically connected to the electrode, applies a spring load to the disconnect spring, and provides thermal capacity to cool the disconnect spring.

In some embodiments, the disconnect spring is formed of a material having a softening temperature greater than 300° C.

According to some embodiments, the thermal disconnector mechanism includes: a first fail-safe mechanism including the solder and a contact portion of the disconnect spring engaging the solder; and a second fail-safe mechanism including a weak region in the disconnect spring between the contact portion and a proximal portion of the disconnect spring, wherein the disconnect spring is configured to break at the weak region in response to a current through the disconnect spring. In some embodiments, the weak region has a reduced cross-sectional area compared to a cross-sectional area of the proximal portion. In some embodiments, the SPD module includes a supplemental spring that applies a spring load to the proximal portion.

According to some embodiments, the SPD module includes a contact member, wherein: the contact member includes the second module terminal; and the disconnect spring is affixed to the contact member. In some embodiments, the disconnect spring is affixed to the contact member by clinching.

According to some embodiments, the SPD module includes an indicator mechanism configured to provide an alert that the SPD module has failed when the thermal disconnector mechanism disconnects the overvoltage clamping element from the second module electrical terminal. In some embodiments, the indicator mechanism includes a local alert mechanism including: a window in the module housing; an indicator member movable between a ready position and an indicating position relative to the window; and an indicator spring configured to force the indicator member from the ready position to the indicating position when the thermal disconnector mechanism disconnects the overvoltage clamping element from the second module electrical terminal. In some embodiments, the indicator mechanism includes a remote alert mechanism including: a switch opening in the module housing to receive a switch pin from an external base assembly; a blocking member covering the switch opening; and an indicator spring configured to force the blocking member away from the switch opening when the thermal disconnector mechanism disconnects the overvoltage clamping element from the second module electrical terminal to permit the switch pin to extend through the switch opening.

According to embodiments of the invention, a surge protective device (SPD) module includes a module housing, first and second module electrical terminals mounted on the module housing, an overvoltage clamping element electrically connected between the first and second module electrical terminals, and a thermal disconnector mechanism positioned in a ready configuration, wherein the overvoltage clamping element is electrically connected with the second module electrical terminal. The thermal disconnector mechanism is repositionable to electrically disconnect the overvoltage clamping element from the second module electrical terminal. The thermal disconnector mechanism includes: an electrode electrically connected to the overvoltage clamping element; a disconnect spring elastically deflected and electrically connected to the electrode in the ready configuration; a first fail-safe mechanism including a solder securing the disconnect spring in electrical connection with the electrode in the ready configuration, wherein: the solder is meltable in response to overheating of the overvoltage clamping element; and the disconnect spring is configured to electrically disconnect the overvoltage clamping element from the second module electrical terminal when the solder is melted; and a second fail-safe mechanism including a weak region in the disconnect spring, wherein the disconnect spring is configured to break at the weak region in response to a current through the disconnect spring to electrically disconnect the overvoltage clamping element from the second module electrical terminal.

According to method embodiments of the invention, a method for forming a surge protective device (SPD) system includes providing an SPD module including: a module housing; first and second module electrical terminals mounted on the module housing; and an overvoltage clamping element electrically connected between the first and second module electrical terminals. The SPD module has a prescribed maximum continuous operating voltage (MCOV) level. The SPD module has a prescribed type. The method further includes providing an SPD base including: a base housing; and first and second base electrical terminals mounted on the base housing. The SPD base has a prescribed maximum continuous operating voltage (MCOV) level. The SPD base has a prescribed type. The method further includes: mounting a module voltage designator member on the module housing in a selected position, wherein the selected position corresponds to the prescribed MCOV level of the SPD module and is one of a plurality of selectable positions each corresponding to a different prescribed MCOV level; mounting a module type designator member on the module housing in a selected position, wherein the selected position corresponds to the prescribed type of the SPD module and is one of a plurality of selectable positions each corresponding to a different type; mounting a base voltage designator member on the base housing in a selected position, wherein the selected position corresponds to the prescribed MCOV level of the SPD base and is one of a plurality of selectable positions each corresponding to a different prescribed MCOV level; and mounting a base type designator member on the base housing in a selected position, wherein the selected position corresponds to the prescribed type of the SPD base and is one of a plurality of selectable positions each corresponding to a different type. The SPD module can be plugged into the SPD base in an installed position wherein the first and second module electrical terminals electrically engage the first and second base electrical terminals, the module voltage designator member is mated with the base voltage designator member, and the module type designator member is mated with the base type designator member. If a user attempts to plug a second SPD module having a module voltage designator member positioned to correspond to a different MCOV level than that of the SPD base and/or a module type designator member positioned to correspond to a different type than that of the SPD base into the SPD base, the base voltage designator member and/or the base type designator member will prevent the second SPD module from being mounted in the installed position.

In some embodiments, the module voltage designator member and the module type designator member each include an integral pin, the base voltage designator member includes an integral socket configured to receive the pin of the module voltage designator member, and the base type designator member includes an integral socket configured to receive the pin of the module type designator member.

Further features, advantages and details of the present invention will be appreciated by those of ordinary skill in the art from a reading of the figures and the detailed description of the preferred embodiments that follow, such description being merely illustrative of the present invention.

BRIEF DESCRIPTION OF THE DRAWINGS

The accompanying drawings, which form a part of the specification, illustrate embodiments of the present invention.

DETAILED DESCRIPTION OF EMBODIMENTS OF THE INVENTION

Figure 1:
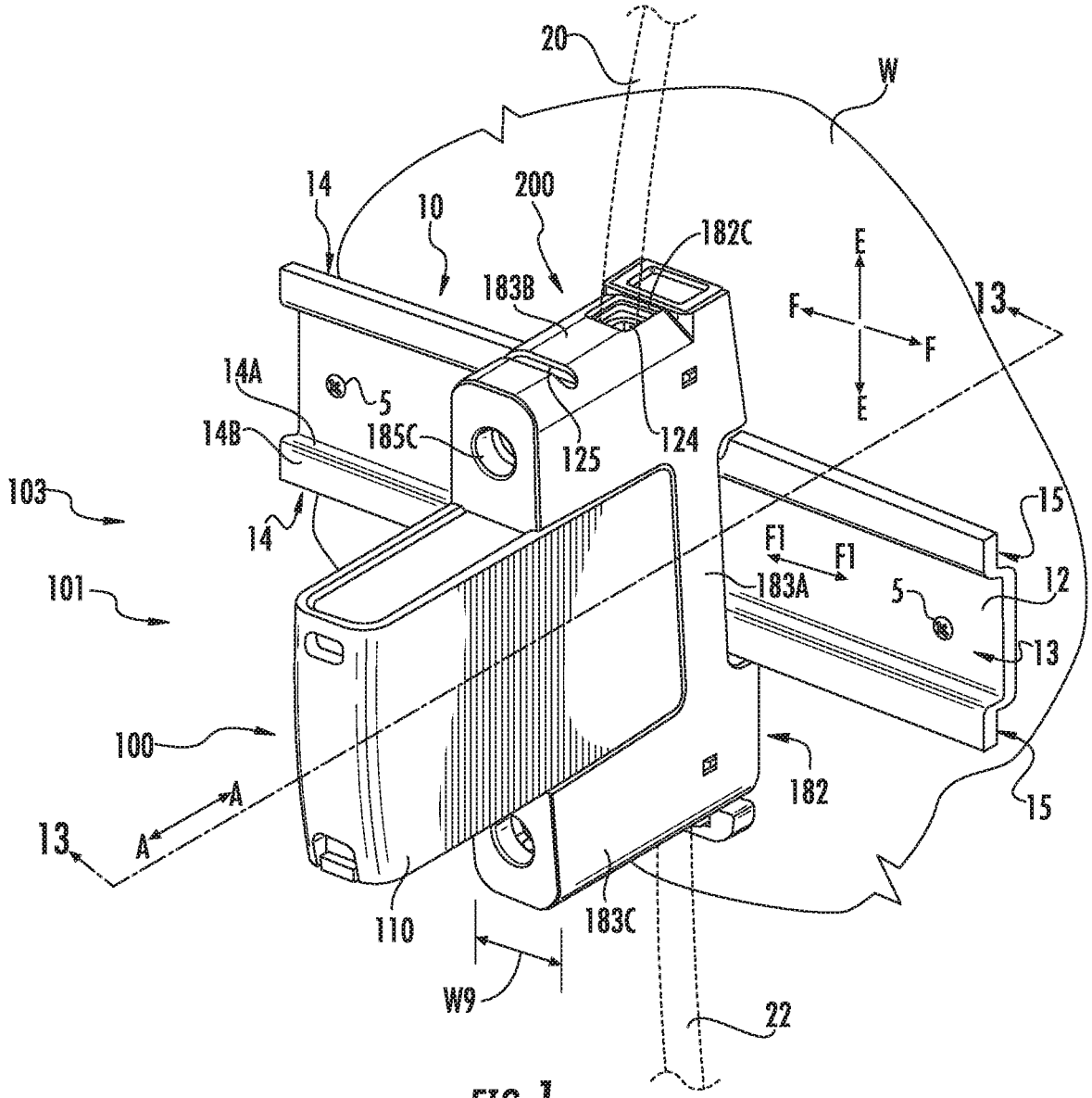
FIG. 1 is a top, front perspective view of an SPD assembly according to embodiments of the invention mounted on a DIN rail.
Figure 2:
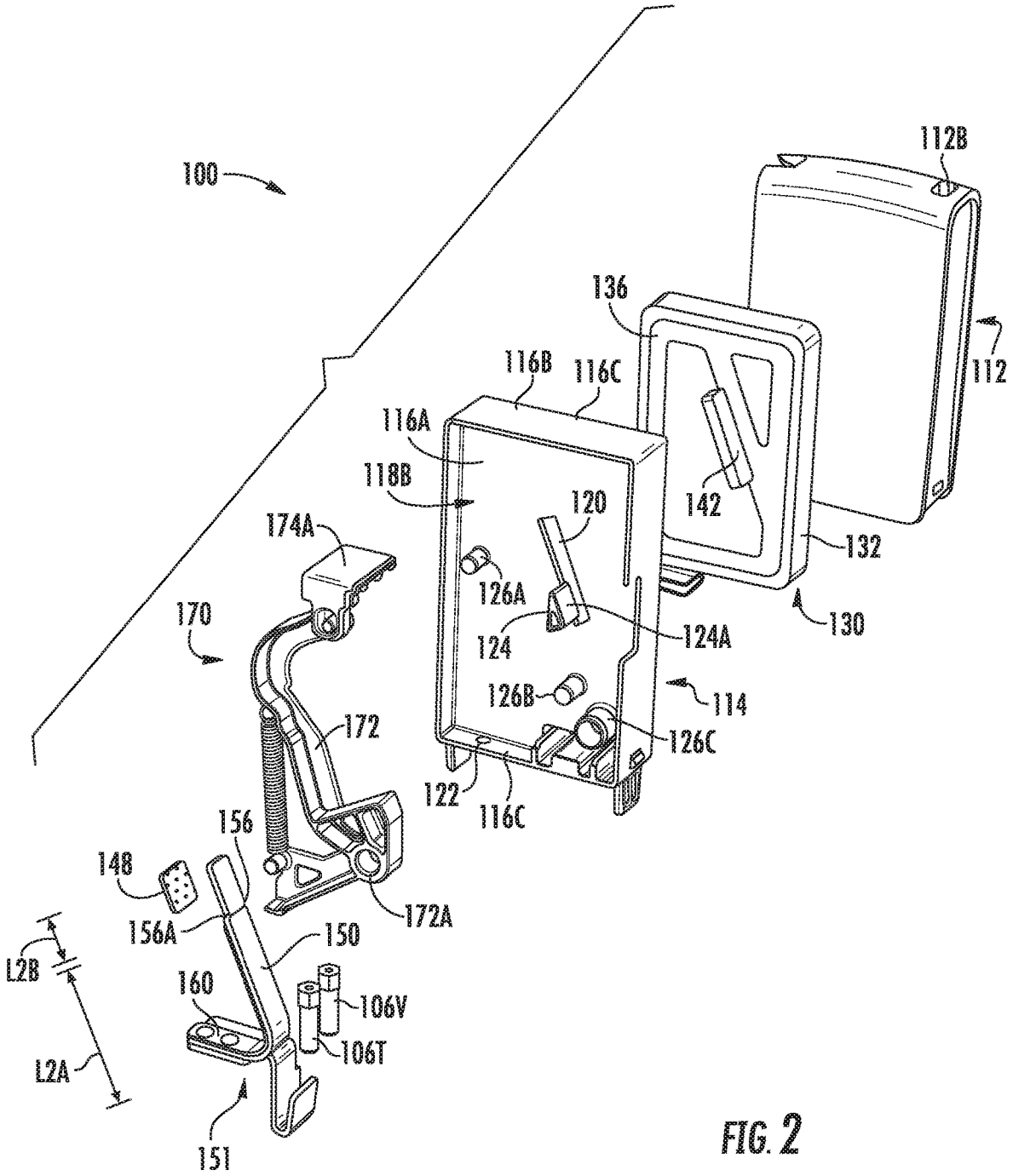
FIG. 2 is an exploded, front, right side perspective view of an SPD module forming a part of the SPD assembly of FIG. 1.
Figure 3:
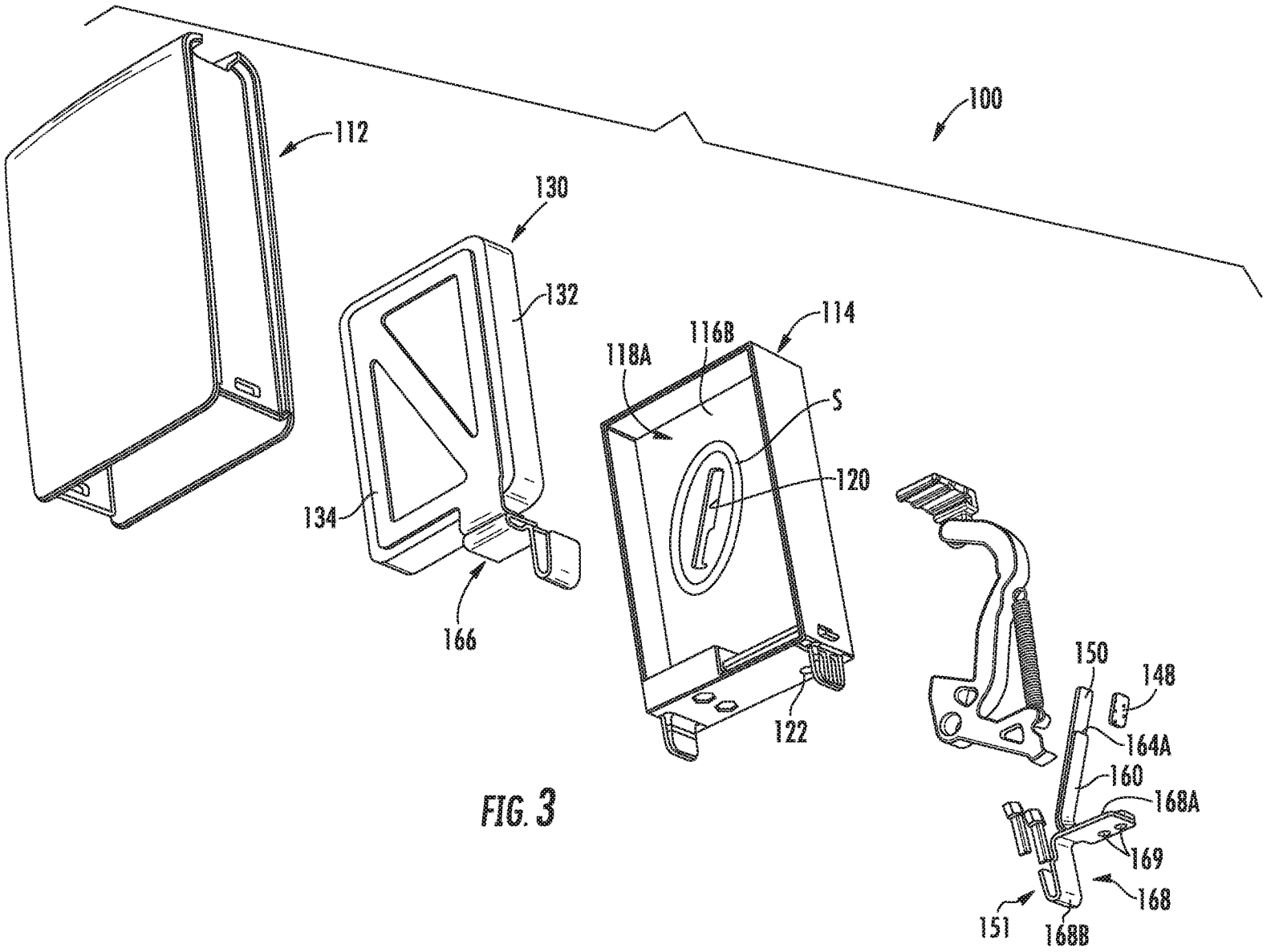
FIG. 3 is an exploded, rear, left side view of the SPD module of FIG. 2.
Figure 4:
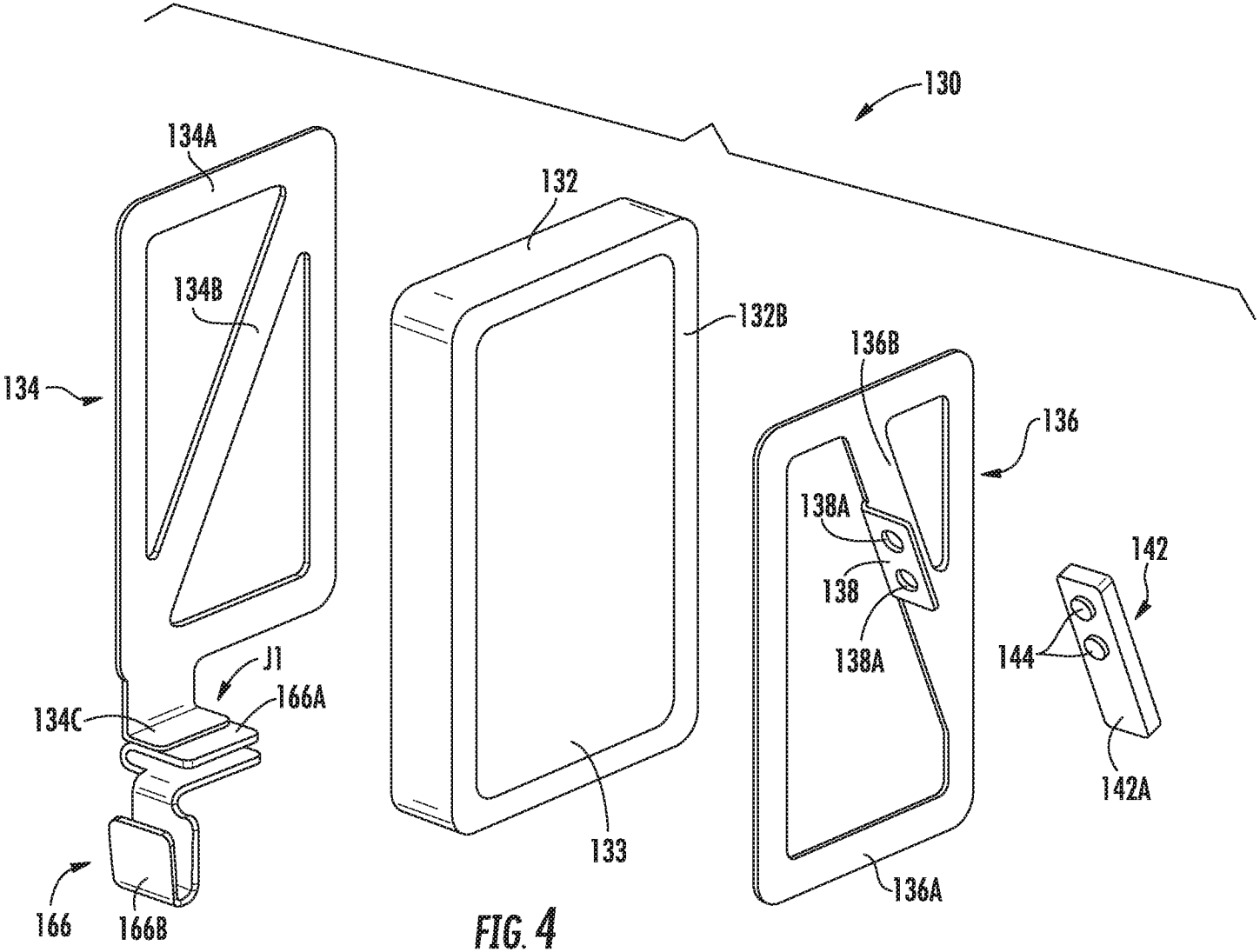
FIG. 4 is an exploded, front, right side view of an overvoltage clamping element assembly forming a part of the SPD module of FIG. 2.
Figure 5:
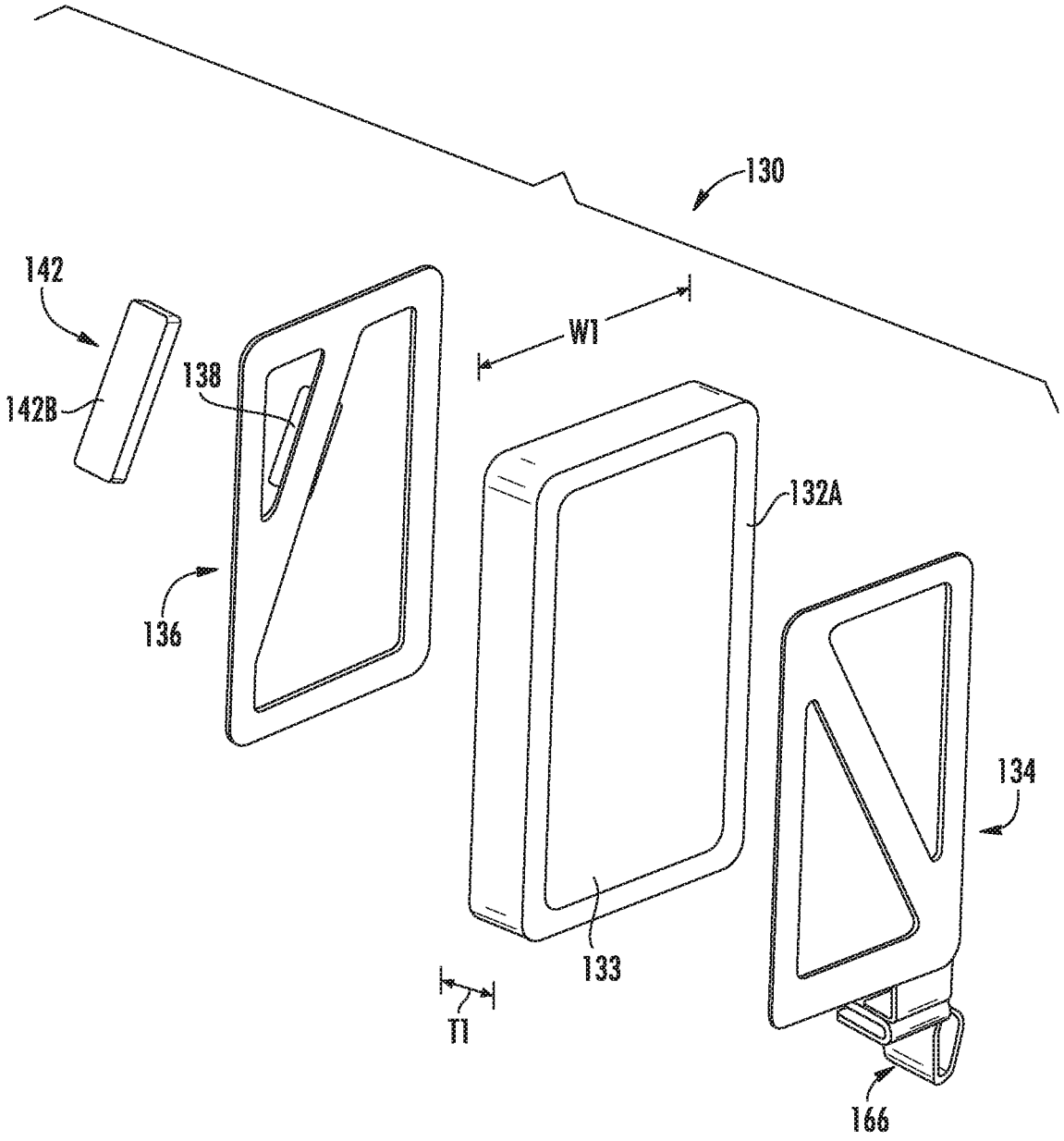
FIG. 5 is an exploded, front, left side view of the overvoltage clamping element assembly of FIG. 4.
Figure 6:
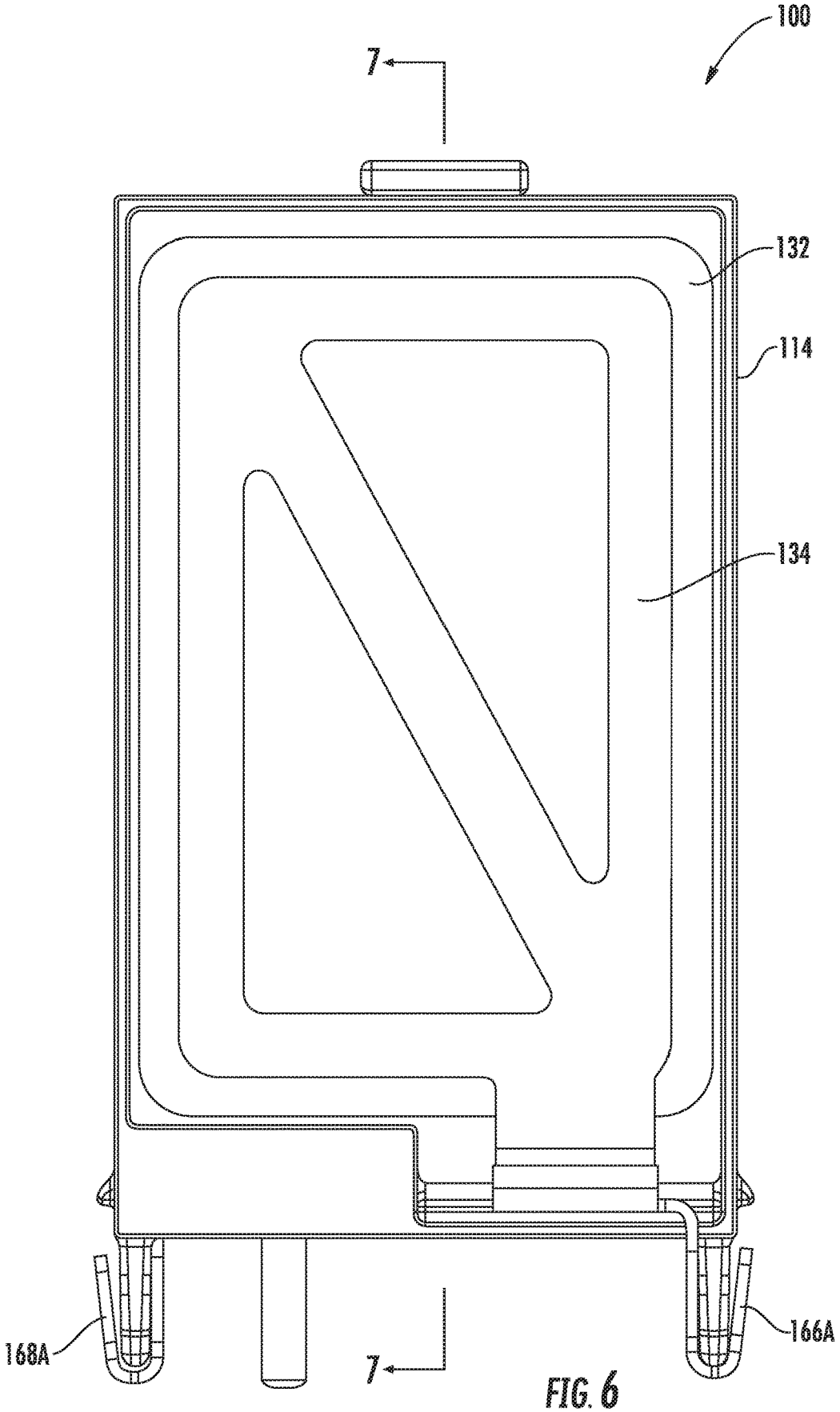
FIG. 6 is a left side view of the SPD module of FIG. 2 with a cover thereof removed.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, "monolithic" means an object that is a single, unitary piece formed or composed of a material without joints or seams. Alternatively, a unitary object can be a composition composed of multiple parts or components secured together at joints or seams.

With reference to FIGS. 1-13, a transient voltage surge suppression (TVSS) or surge protective device (SPD) assembly 101 and an SPD system 103 according to embodiments of the present invention are shown therein. The SPD assembly 101 and system 103 include an SPD module 100 and a pedestal or base 200. The SPD module 100 is pluggable into the base 200.

According to some embodiments and as shown, the SPD assembly 101 is configured, sized and shaped for mounting on a support rail 10 (e.g., DIN rail 10 shown in FIG. 1) and is compliant with corresponding applicable DIN requirements or standards. The DIN rail 10 may be secured (e.g., by screws 5 or other fasteners) to a suitable support structure such as a wall W, for example, a rear wall of an electrical service utility cabinet. The base 200 is removably mountable on the DIN rail 10. The pluggable surge protective device (SPD) module 100 is in turn removably mountable on the base 200.

In some embodiments, the maximum dimensions of the SPD assembly 101 are compliant with at least one of the following DIN (Deutsches Institut für Normung e.V.) Standards: DIN 43 880 (December 1988). In some embodiments, the maximum dimensions of the assembly 101 are compliant with each of these standards.

According to some embodiments and as shown, the rail 10 is a DIN rail. That is, the rail 10 is a rail sized and configured to meet DIN specifications for rails for mounting modular electrical equipment.

The DIN rail 10 has a rear wall 12 and integral, lengthwise flanges 14 extending outwardly from the rear wall 12. Each flange 14 includes a forwardly extending wall 14A and an outwardly extending wall 14B. The walls 12, 14 together form a lengthwise extending front, central channel 13 and opposed, lengthwise extending, rear, edge channels 15. Mounting holes 16 may be provided extending fully through the wall 12 and to receive fasteners (e.g., threaded fasteners or rivets) for securing the rail 10 to a support structure (e.g., a wall or panel). The DIN rail 10 defines a DIN rail plane E-F and has a lengthwise axis F1-F1 extending in the plane E-F. DIN rails of this type may be referred to as "top hat" support rails.

According to some embodiments, the rail 10 is a 35 mm (width) DIN rail. According to some embodiments, the rail 10 is formed of metal and/or a composite or plastic material.

The assembly 100 has a DIN rail device assembly axis A-A (FIG. 1) that extends transversely to and, in some embodiments, substantially perpendicular to the axis F1-F1 of the DIN rail 10. In some embodiments, the DIN rail mount assembly axis A-A extends transversely to and, in some embodiments, substantially orthogonal to the plane E-F of the DIN rail 10. As used herein, "front" or "distal" refers to the end farther away from the DIN rail 10 when the assembly 101 is mounted on the DIN rail 10, and "rear" or "proximal" refers to the end nearer the DIN rail 10.

The base 200 (FIGS. 1, 12 and 13) includes a rear housing member 182B and a front housing member or cover 182A collectively forming a housing 182. The housing 182 includes a rear section 183A, an upper leg or section 183B, and a lower leg or section 183C. The housing 182 defines an enclosed internal cavity. According to some embodiments, the housing members 182A, 182B are formed of an electrically insulating polymeric material.

The housing members 182A, 182B may be formed of any suitable material or materials. In some embodiments, each of the housing members 182A, 182B are formed of a rigid polymeric material or metal (e.g., aluminum). Suitable polymeric materials may include polyamide (PA), polypropylene (PP), polyphenylene sulfide (PPS), or ABS, for example.

A DIN rail receiver channel 182F is defined in the rear side of the rear section 183A. Integral rail hook features 182H are located on one side of the channel 182F and a spring loaded DIN rail latch mechanism 182G is mounted on the other side of the channel 182F. The features and components 182F, 182G, 182H are sized and configured to securely and releasably mount the base 200 on a standard DIN rail 10 as is known in the art.

A receiver slot 183D is defined in the front side of the base 200 by the sections 183A-C. The receiver slot 183D has a front opening and is open on either side. The receiver slot 183D extends axially from the opening along the axis A-A and is terminated by the front side of the rear section 183A.

A base terminal electrical connector assembly 184, 186 is mounted in each of the upper and lower sections 183B, 183C. Each connector assembly 184, 186 includes a cable clamp connector 185A and a terminal contact connector socket 185B. A cable port 182C is defined in each of the upper and lower sections 183B, 183C to receive a terminal end of an electrical cable 20, 22 into the corresponding cable clamp connector 185A. A driver port 185C is provided in each section 183B, 183C to receive a driver to operate a threaded member (e.g., screw) 185D of the associated cable clamp connector 185A.

Upper and lower contact openings 182E are defined in the front side or wall of the rear section 183A. Designator pin openings 182V and 182T are also defined in the front side or wall of the rear section 183A.

A voltage designator socket member or insert 109V is secured in (e.g., press-fit into) the opening 182V. A type designator socket member or insert 109T is secured in (e.g., press-fit into) the opening 182T. The inserts 109V and 109T include sockets 109VS and 109TS, respectively, defined therein.

A switch 188 is disposed in the housing 182. The switch 188 includes a spring-loaded remote control pin 188A that projects forwardly from the front side of the rear section 183A. The switch 188 further includes switch electronics 188B mounted on a PCB 188E and connected to the control pin 188A and an output electrical connector 188D.

The SPD module 100 includes a housing 110 and an overvoltage clamping element assembly 130, an integral thermal disconnector mechanism 140, an integral indicator mechanism 170 (including a local alarm mechanism 170A, and a remote alert mechanism 170B), a first fail-safe mechanism 102, and a second fail-safe mechanism 104 disposed in the housing 110, as discussed in more detail below. The SPD module 100 further includes a voltage designator pin member or insert 106V, a type designator pin member or insert 106T, potting P (shown only in FIG. 7), silicone S, a first electrical contact member 166, and a second electrical contact member 168.

The housing 110 includes an inner housing member or frame 114 and an outer housing member or cover 112 collectively forming the housing 110 (FIGS. 1-13). The housing 110 defines an internal chamber or cavity.

A front indicator opening or window 112B is provided on a front wall of the cover 112. The indicator window 112B may serve to visually indicate a change in status of the module 100, as discussed below.

The frame 114 includes a partition wall 116A separating opposed cavities 118A and 118B. An electrode slot 120 is defined in the partition wall 116A and connects the cavities 118A, 118B. The frame 114 includes a front wall 116B and a rear wall 116C. A switch opening 122 is defined in the rear wall 116C. The pin inserts 106V and 106T are secured in (e.g., press-fit into) sockets 105V and 105T, respectively, in the rear wall 116C.

An integral reinforcement structure 124, an integral spring anchor post 126A, an integral pivot post 126B, and a spring brace post 126C each project laterally into the cavity 118B from the partition wall 116A. The reinforcement structure 124 has a substantially planar platform or engagement surface 124A.

The housing members 112, 114 may be formed of any suitable material or materials. In some embodiments, each of the housing members 112, 114 is formed of a rigid polymeric material. Suitable polymeric materials may include polyamide (PA), polypropylene (PP), polyphenylene sulfide (PPS), or ABS, for example.

In some embodiments and as shown, the overvoltage clamping element assembly 130 is a varistor assembly including a varistor 132, a first electrode 134 and a second electrode 136. The varistor 132 has opposed contact surfaces 132A, 132B. Metallization layers 133 cover the contact surfaces 132A, 132B. The first electrode 134 is bonded to the metallization layer 133 of the contact surface 132A by solder and the second electrode 136 is bonded to the metallization layer 133 of the contact surface 132B by solder so that the electrodes 134 and 136 are electrically connected to the contact surfaces 132A and 132B, respectively.

The first electrode 134 includes a perimeter portion 134A, a cross or brace leg 134B, and a termination tab 134C. The first electrode 134 is electrically conductive. In some embodiments, the first electrode 134 is formed of metal. Suitable metals may include nickel brass or copper alloys such as CuSn 6 or Cu-ETP. In some embodiments, the first electrode 134 is unitary (composite or monolithic) and, in some embodiments, the first electrode 134 is monolithic.

Figure 9:
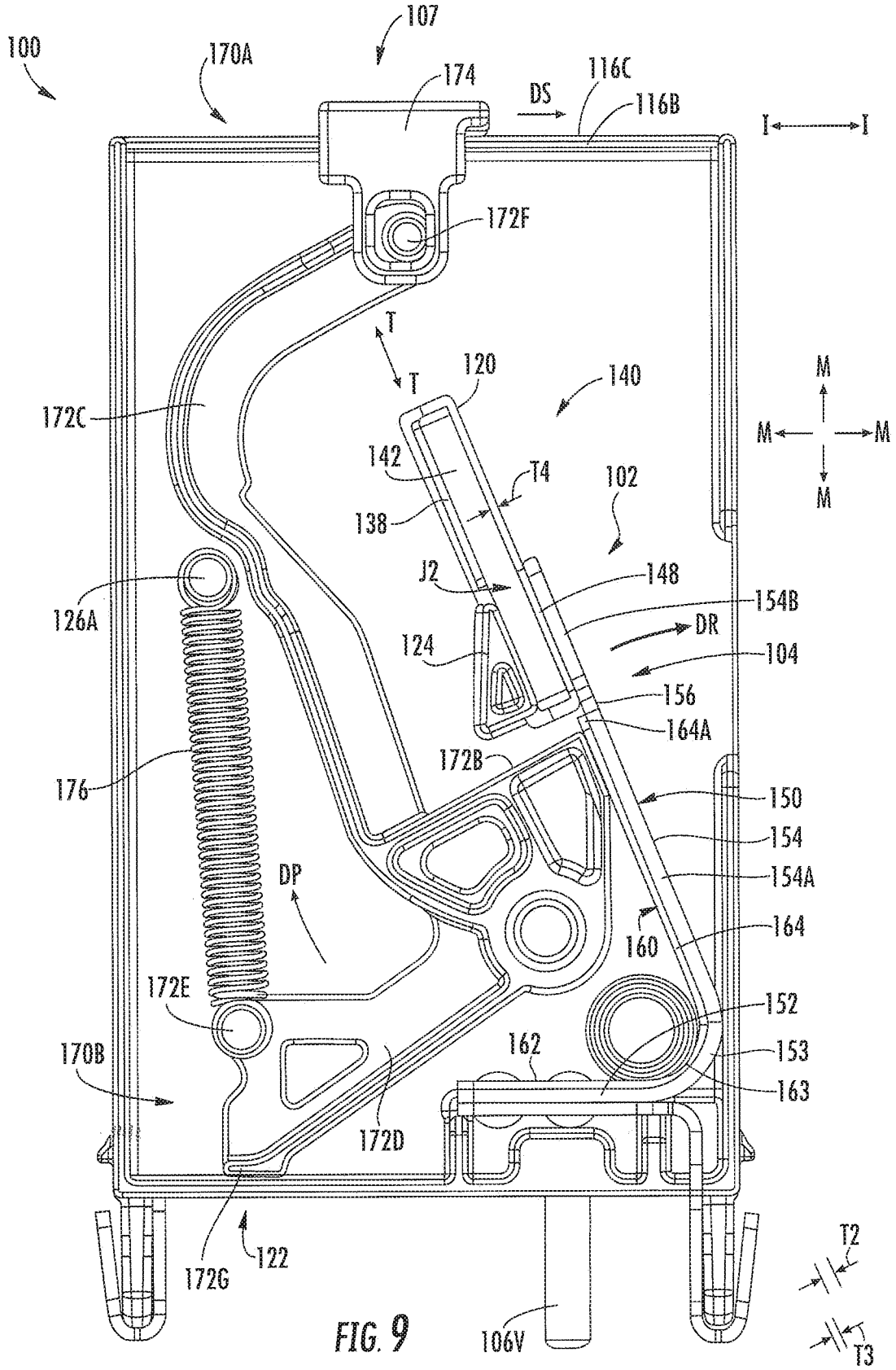
FIG. 9 is a right side view of the SPD module of FIG. 2 with the cover removed and a thermal disconnector mechanism thereof in a ready configuration.

The second electrode 136 includes a perimeter portion 136A, a cross or brace leg 136B, and a termination tab 138. The termination tab 138 has a substantially planar contact surface 138A defining a tab plane T-T (FIG. 9). In some embodiments, the tab plane T-T is substantially orthogonal to the plane M-M (FIGS. 7 and 9) defined by the contact surface 132B.

The second electrode 136 is electrically conductive. In some embodiments, the second electrode 136 is formed of metal. Suitable metals may include nickel brass or copper alloys such as CuSn 6 or Cu-ETP In some embodiments, the second electrode 136 is unitary (composite or monolithic) and, in some embodiments, the second electrode 136 is monolithic.

The thickness and the diameter of the varistor 132 will depend on the varistor characteristics desired for the particular application. In some embodiments, the varistor 132 has a width W1 (FIG. 5) to thickness T1 ratio of at least 2. In some embodiments, the thickness T1 of the varistor 132 is in the range of from about 0.75 to 15 mm.

The varistor material of the varistor 132 may be any suitable material conventionally used for varistors, namely, a material exhibiting a nonlinear resistance characteristic with applied voltage. In some embodiments, the varistor 132 is a metal oxide varistor (MOV). Preferably, the resistance becomes very low when a prescribed voltage is exceeded. The varistor material may be a doped metal oxide or silicon carbide, for example. Suitable metal oxides include zinc oxide compounds.

The varistor assembly 130 is contained in the cavity 118A such that the terminal tab 138 extends through the slot 120 and into the cavity 118B. The silicone S surrounds the slot 120. The remainder of the space in the cavity 118A is filled with the potting P. The silicone S prevents the potting from entering the region about the slot 120 so that the potting does not intrude into the cavity 118B where it might interfere with the engagements and mechanisms present in the cavity 118B.

The thermal disconnector mechanism 140 includes a heat sink member 142, a disconnect spring 150, a supplemental spring 160, and a layer of solder 148.

The heat sink member 142 has opposed inner and outer faces 142A and 142B. The heat sink member 142 is affixed to the face 138A of the tab 138 to provide good electrical conductivity and thermal conductivity between the tab 138 and the inner face 142A of the heat sink member 142. The heat sink member 142 may be secured to the tab 138 by any suitable technique. In some embodiments and as shown, the heat sink member 142 is secured to the tab 138 by a plurality of rivets 144. Holes 138A are provided in the tab 138 to receive and secure the rivets 144. In some embodiments, the heat sink member 142 is secured to the tab 138 by a plurality of TOX or clinch rivets. In some embodiments, the heat sink member 142 is secured to the tab 138 by a weld.

As used herein, the term "thermal capacity" means the product of the specific heat of the material or materials of the object multiplied by the mass or masses of the material or materials of the object. That is, the thermal capacity is the quantity of energy required to raise one gram of the material or materials of the object by one degree centigrade times the mass or masses of the material or materials in the object.

According to some embodiments, the thermal capacity of the heat sink member 142 is in the range of from about 0.2 to 2.0 Joules/Kelvin (J/K).

According to some embodiments, the thermal capacity of the heat sink member 142 is substantially greater than the thermal capacity of the second electrode 136. According to some embodiments, the thermal capacity of the heat sink member 142 is substantially lower than the thermal capacity of the second electrode 136. According to some embodiments, the thermal capacity of the heat sink member 142 is at least 0.15 times the thermal capacity of the second electrode 136 and, in some embodiments, is in the range of from about 0.15 to 2.5 times the thermal capacity of the second electrode 136.

According to some embodiments, the thermal capacity of the heat sink member 142 is substantially greater than the thermal capacity of the electrode tab 138. According to some embodiments, the thermal capacity of the heat sink member 142 is at least 3 times the thermal capacity of the electrode tab 138 and, in some embodiments, is in the range of from about 3 to 10 times the thermal capacity of the electrode tab 138.

According to some embodiments, the thermal capacity of the heat sink member 142 is substantially greater than the thermal capacity of the contact portion 154B (discussed below) of the disconnect spring 150. According to some embodiments, the thermal capacity of the heat sink member 142 is at least 3 times the thermal capacity of the contact portion 154B and, in some embodiments, is in the range of from about 3 to 10 times the thermal capacity of the contact portion 154B.

According to some embodiments, the thermal capacity of the heat sink member 142 is substantially greater than the combined thermal capacities of the electrode tab 138 and the contact portion 154B. According to some embodiments, the thermal capacity of the heat sink member 142 is at least 3 times the combined thermal capacities of the electrode tab 138 and the contact portion 154B and, in some embodiments, is in the range of from about 3 to 8 times the combined thermal capacities of the electrode tab 138 and the contact portion 154B.

According to some embodiments, the heat sink member 142 has a mass in the range of from about 0.5 to 2.5 g. According to some embodiments, the mass of the heat sink member 142 is in the range of from about 0.2 to 10 times the mass of the electrode tab 138 and, in some embodiments, in the range of from about 5 to 10 times the mass of the electrode tab 138.

According to some embodiments, the heat sink member 142 is formed of metal. In some embodiments, the heat sink member 142 is formed of a metal selected from the group consisting of copper, brass or other suitable copper alloys or other metal or alloys with suitable thermal capacity and thermal conductivity.

According to some embodiments, the specific heat capacity of the material forming the heat sink member 142 is in the range of from about 100 to 1200 J/kg-K.

The heat sink member 142 may be formed by any suitable technique. In some embodiments, the heat sink member 142 is monolithic.

In some embodiments, the heat sink member 142 is formed of a material having a thermal conductivity of at least about 200 W/mK.

In some embodiments, the heat sink member 142 is formed of a material having an electrical conductivity of at least about $2.5\times10^7$ S/m.

The disconnect spring 150 includes a base leg 152 and a cantilevered free leg 154 joined to the base leg 152 by a radiused bend 153. The free leg 154 includes a lower portion 154A proximate the bend 153 and an upper contact portion 154B distal from the bend 153. The contact portion 154B includes an inner contact face facing the heat sink member 142. A weak region 156 is located in the spring 150 between the lower portion 154A and the contact portion 154B. The weak region 156 includes a notch 156A defined in the side edge of the spring 150. As a result, the spring 150 has a reduced cross-sectional area at the weak region 156.

According to some embodiments, the spring 150 has a thickness T2 (FIG. 9) in the range of from about 0.2 mm to 1 mm. According to some embodiments, the thickness T2 of the spring 150 is substantially uniform from end to end.

According to some embodiments, the spring 150 has a width W2 (FIG. 7) in the range of from about 3 mm to 10 mm. According to some embodiments, the width W2 of the spring 150 is substantially uniform from end to end.

According to some embodiments, the length L2A (FIG. 2) of the lower portion 154A is in the range of from about 15 mm to 35 mm.

According to some embodiments, the length L2B (FIG. 2) of the contact portion 154B is in the range of from about 2 mm to 15 mm.

The spring 150 may be formed of any suitable material or materials. In some embodiments, the spring 150 is formed of metal. Suitable metal materials may include CuSn 0.15 alloy (bronze), nickel brass, CuSn6, Cu-ETP, oxygen free copper, for example. According to some embodiments, the spring 150 has a restoring force in the ready position (FIG. 9) in the range of from about 5 N to 30 N. According to some embodiments, the spring is formed of a material (e.g., a metal) having a softening temperature greater than 300° C. In some embodiments, the spring 150 is unitary (composite or monolithic) and, in some embodiments, the spring 150 is monolithic. In some embodiments, the spring 150 is formed (e.g., cut and bent) from sheet metal.

According to some embodiments, the spring 150 has an electrical conductivity of at least 14 nΩ·m (at 20° C.).

The supplemental spring 160 includes a base leg 162 and a cantilevered free leg 164 joined to the base leg 162 by a radiused bend 163. The free leg 164 extends from the bend 163 to a distal terminal end 164A. The terminal end 164A is located proximate the weak region 156. The free leg 164 may be substantially coextensive with the lower leg 154A.

According to some embodiments, the spring 160 has a thickness T3 (FIG. 9) in the range of from about 0.2 mm to 0.9 mm. According to some embodiments, the thickness T3 of the spring 160 is substantially uniform from end to end.

According to some embodiments, the spring 160 has a width in the range of from about 3 mm to 10 mm. According to some embodiments, the width of the spring 160 is substantially uniform from end to end.

According to some embodiments, the length of the free leg 164 is in the range of from about 5 mm to 15 mm.

The spring 160 may be formed of any suitable material or materials. In some embodiments, the spring 160 is formed of metal. Suitable metal materials may include CuSn 0.15 alloy (bronze), CuSn6, Cu-ETP, oxygen free copper, for example. According to some embodiments, the spring 160 has a restoring force in the ready position (FIG. 9) in the range of from about 0.5 N to 5 N. In some embodiments, the spring 160 is formed of a material (e.g., a metal) having a softening temperature greater than 300° C. In some embodiments, the spring 160 is unitary and, in some embodiments, the spring 160 is monolithic. In some embodiments, the spring 160 is formed (e.g., cut and bent) from sheet metal. In some embodiments, the spring 160 is formed of a different material than the spring 150.

According to some embodiments, the spring 160 has an electrical conductivity of at least 14 nΩ·m (at 20° C.).

The first electrical contact member 166 (FIG. 4) includes a base 166A and an integral U-shaped terminal connector 166B. The base 166A is secured to the contact tab 134C of the first electrode 134 by solder or welding, for example, at a joint J1.

The relative positions of the parts 134C and 166A can be adjusted or varied when forming the joint J1 during manufacture. For example, the lateral position of the contact member 166 relative to the first electrode member 134 can be adjusted and then secured (e.g., by solder or welding) to accommodate varistors 132 of different thicknesses. This floating contact or joint can allow varistors 132 of different thicknesses of to be assembled using the same electrode 134.

The second electrical contact member 168 (FIG. 3) includes a base 168A and an integral U-shaped terminal connector 168B. The springs 150 and 160 are secured to the base 168A by rivets 169. The springs 150, 160 and the base 168A thus assembled collectively form a spring/contact subassembly 151.

The contact members 166, 168 may be formed of any suitable material or materials. In some embodiments, the contact members 166, 168 are formed of metal. Suitable metal materials may include nickel brass, CuSn 0.15, CuSN 6, CuP 0.008, for example. In some embodiments, each contact members 166, 168 is unitary and, in some embodiments, is monolithic.

The solder 148 may be formed of any suitable material or materials. In some embodiments, the solder 148 is formed of metal. Suitable metal materials may include 58Bi42Sn for example.

According to some embodiments, the solder 148 is selected such that its melting point is greater than a prescribed maximum standard operating temperature, but less than or equal to a prescribed disconnect temperature. The maximum standard operating temperature may be the greatest temperature expected in the solder 148 during normal operation (including handling overvoltage surges within the designed for range of the module 100). The prescribed disconnect temperature is the temperature of the solder 148 at with the solder 148 is intended to release the spring 150 in order to actuate the first fail-safe mechanism 102.

According to some embodiments, the solder 148 has a melting point in the range of from about 109° C. to 160° C. and, in some embodiments, in the range of from about 85° C. to 200° C.

According to some embodiments, the solder 148 has an electrical conductivity in the range of from about 100 Siemens/meter (S/m) to 200 S/m and, according to some embodiments, in the range of from about 50 S/m to 500 S/m.

According to some embodiments, the layer of solder 148 has a thickness T4 (FIG. 9) in the range of from about 0.05 mm to 0.5 mm. According to some embodiments, the thickness T4 is substantially uniform from end to end.

According to some embodiments, the layer of solder 148 has area in the range of from about 25 $mm^2$ to 45 $mm^2$. According to some embodiments, the layer of solder 148 covers at least about 85 percent of the overlap area between the heat sink member 142 and the contact portion 154B.

The indicator mechanism 170 includes a swingarm 172, an indicator shuttle or member 174, and an indicator spring 176. The swingarm 172 includes a pivot bore 172A from which a trigger leg 172B, an indicator leg 172C, and a switch leg 172D radially extend. An integral spring anchor post 172E is provided on the switch leg 172D.

A post 172F on the indicator leg 172C couples the indicator member 174 to the leg 172C. The indicator member 174 includes an indicator surface 174A. The indicator member 174 is slidably secured to the rail or frame front wall 116B to slide along an indicator axis I-I (FIG. 9).

The indicator spring 176 is secured at either end to the anchor post 172E and the anchor post 126A, and is elastically stretched so that it exerts a persistent pull force on the switch leg 172D.

The swingarm 172 and the indicator member 174 may be formed of any suitable material or materials. In some embodiments, the components 172, 174 are formed of a rigid polymeric material. Suitable polymeric materials may include polyamide (PA), polypropylene (PP), polyphenylene sulfide (PPS), or ABS, for example.

Figure 7:
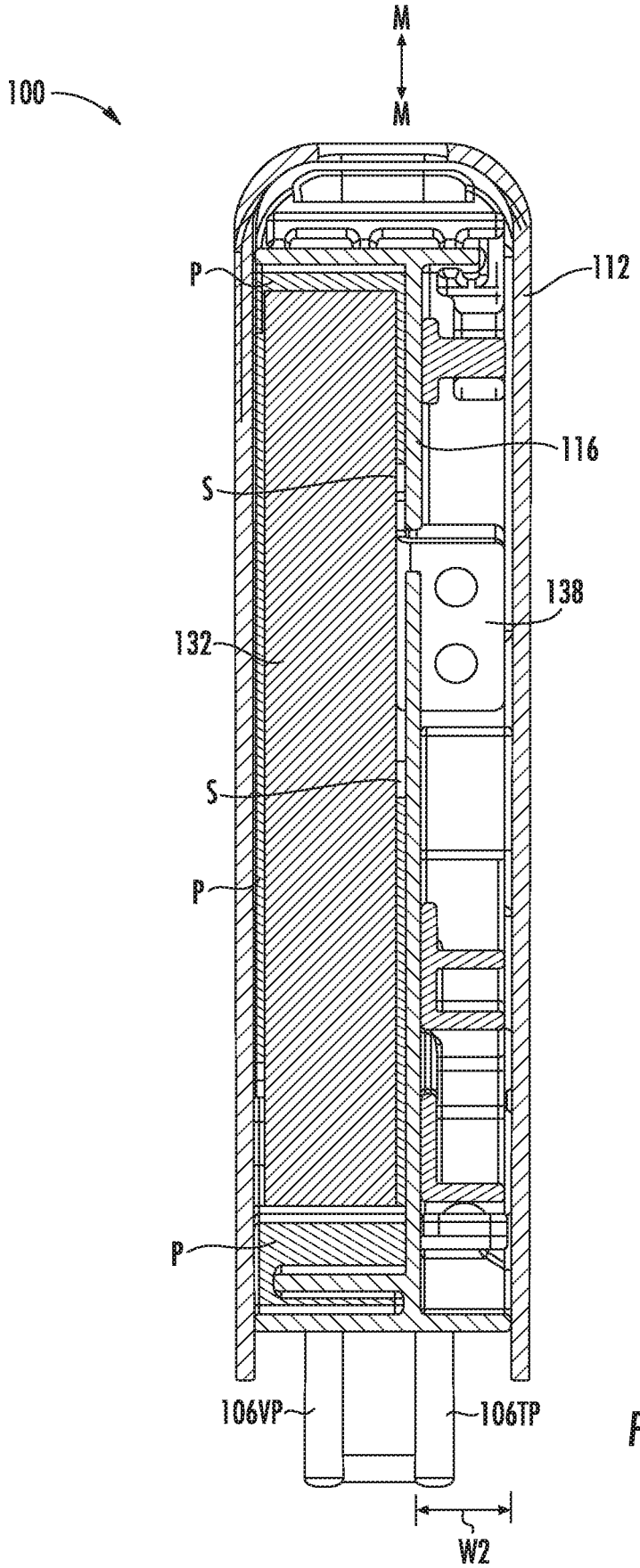
FIG. 7 is a cross-sectional view of the SPD module of FIG. 2 taken along the line 7-7 of FIG. 6.
Figure 8:
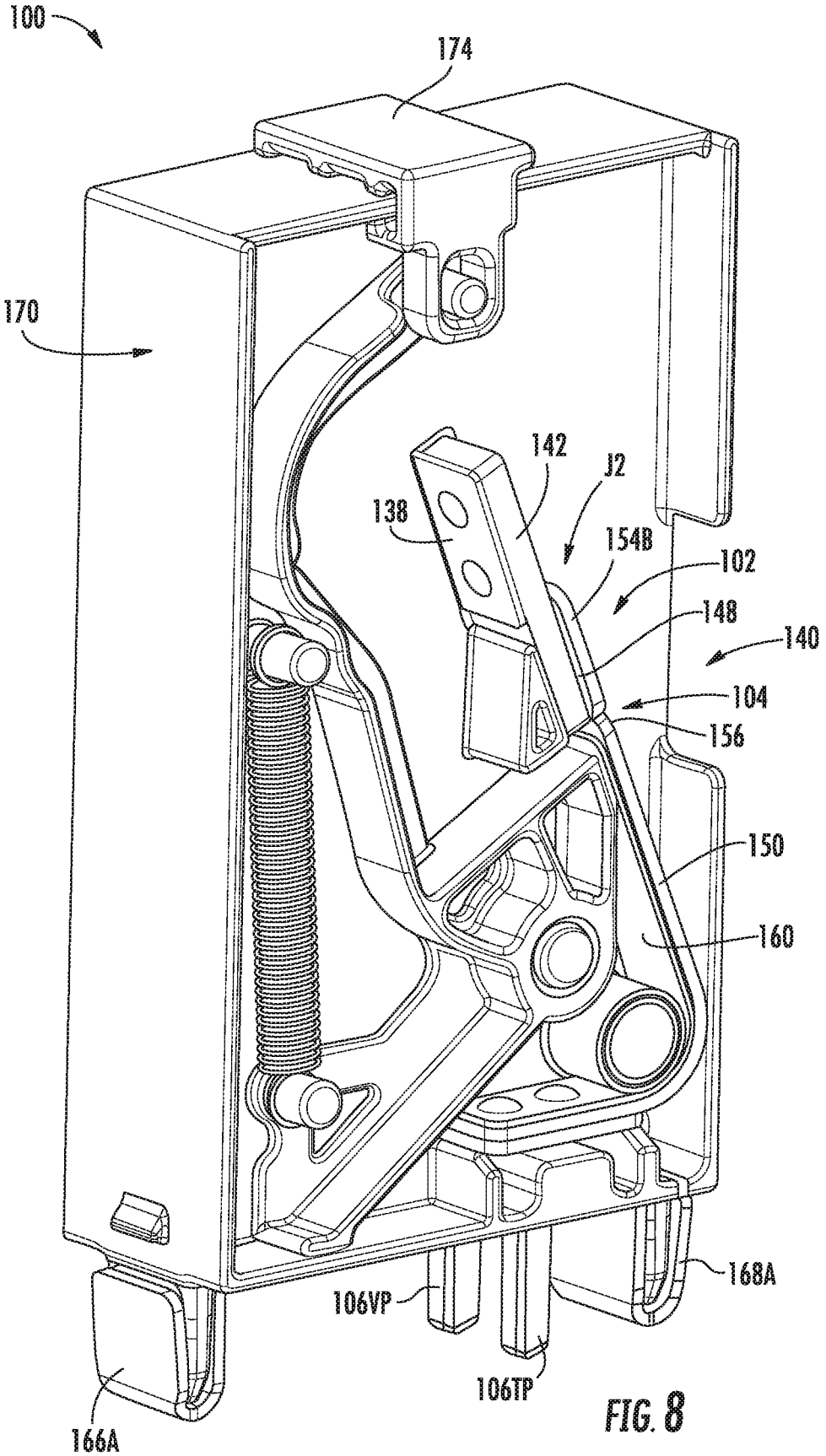
FIG. 8 is a front, bottom perspective view of the SPD module of FIG. 2 with the cover removed.

When the module 100 is assembled in the ready configuration as shown in FIGS. 7-9), the disconnect spring 150 is elastically bent, deformed or deflected so that it persistently exerts a biasing load on the solder 148 pulling away from the heat sink member 142 in a release direction DR. The supplemental spring 160 is likewise elastically bent, deformed or deflected so that it persistently exerts a biasing load against the disconnect spring 150 in the release direction DR.

In the ready configuration, the swingarm 172 is locked in the position shown in FIG. 9 by the disconnect spring 150. The indicator spring 176 is elastically extended or stretched so that it persistently exerts a biasing load pulling the leg 172D in a pivot direction DP (i.e., toward the front wall 116B). The indicator member 174 is thereby secured in the ready position wherein the indicator surface 174A is not aligned with and visible through the window 112B.

The system 101 may be used as follows in accordance with methods of the present invention.

Figure 14:
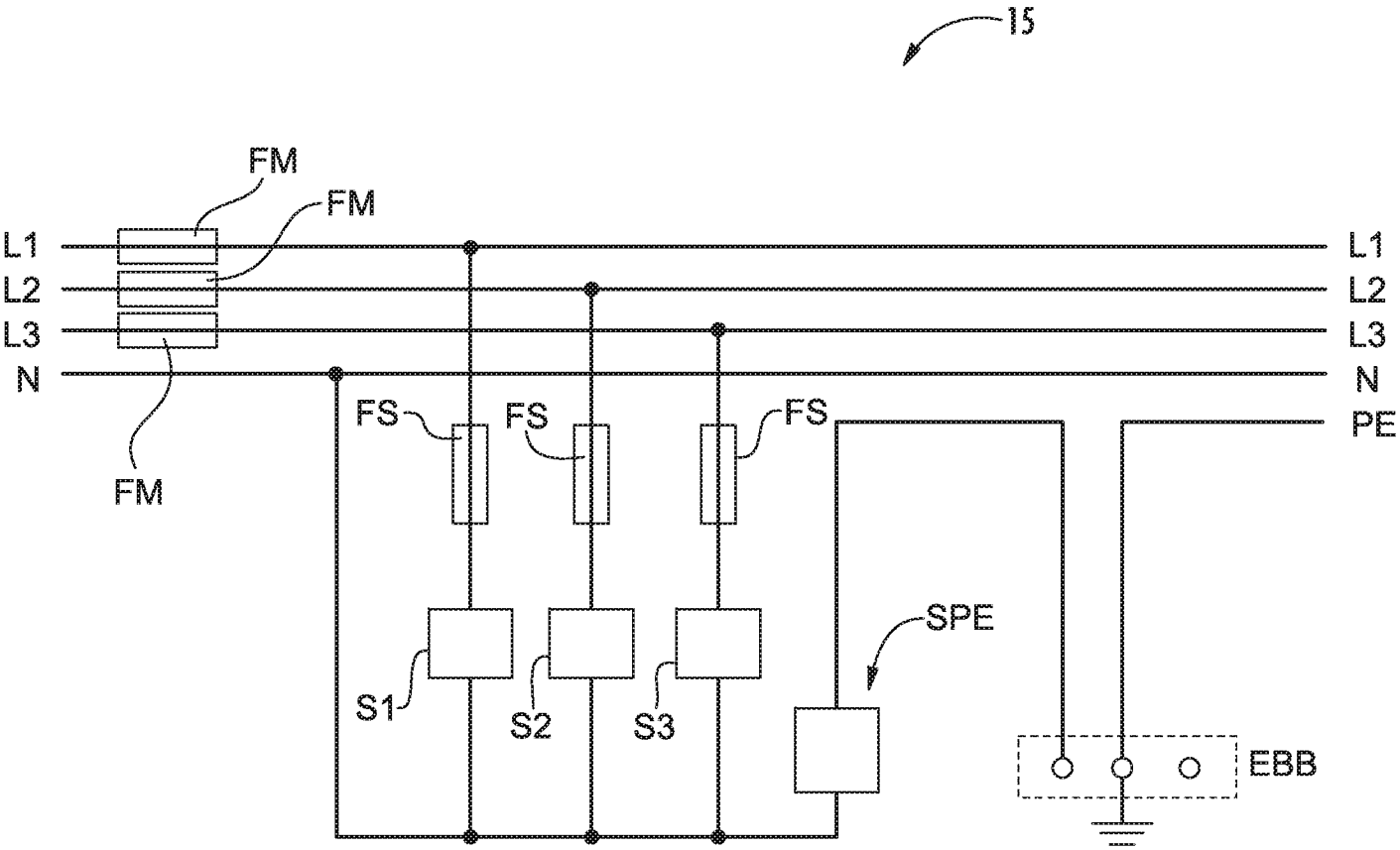
FIG. 14 is a schematic electrical circuit diagram of an electrical circuit including the SPD assembly of FIG. 1.
Figure 15:
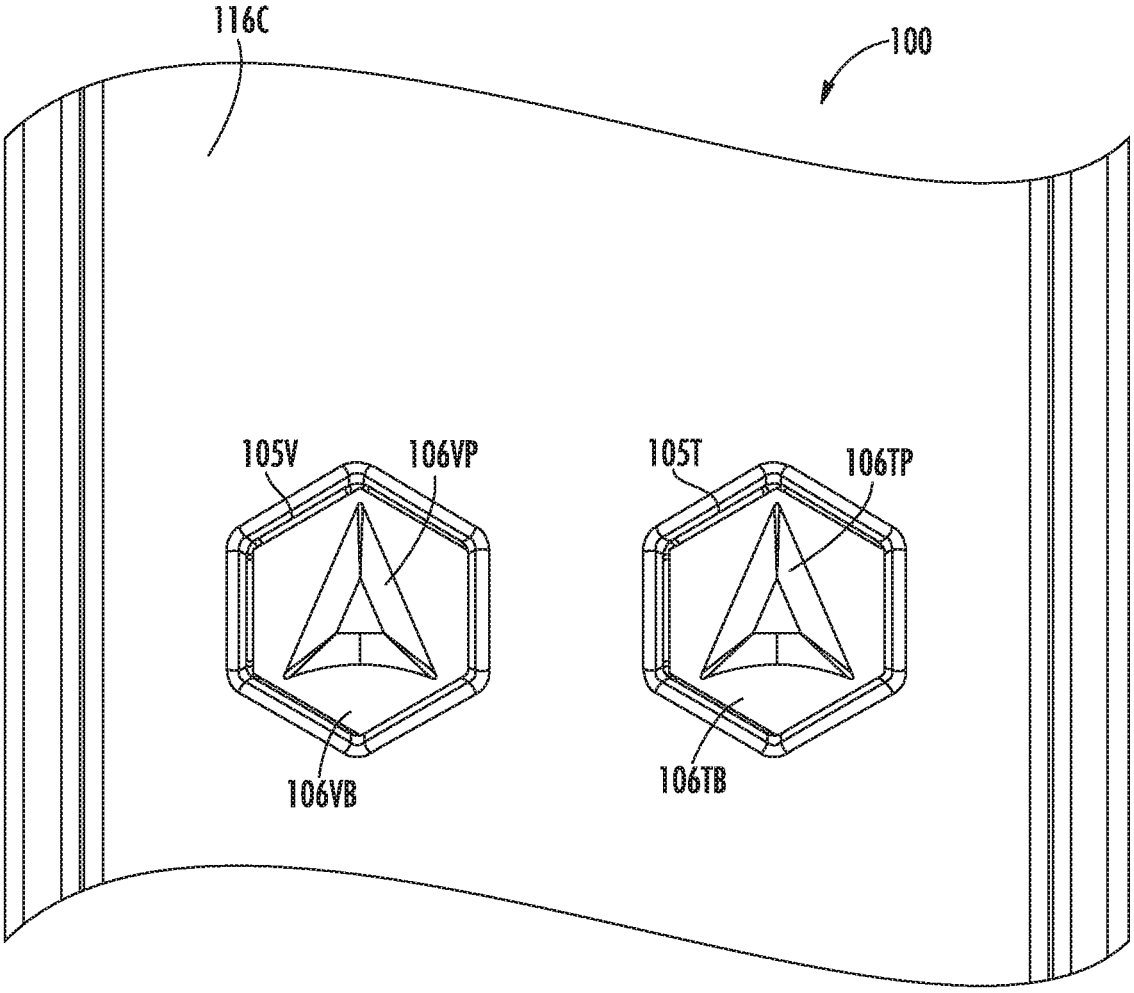
FIG. 15 is an enlarged, fragmentary, rear view of the module of FIG. 2 showing designator pins thereof.
Figure 16:
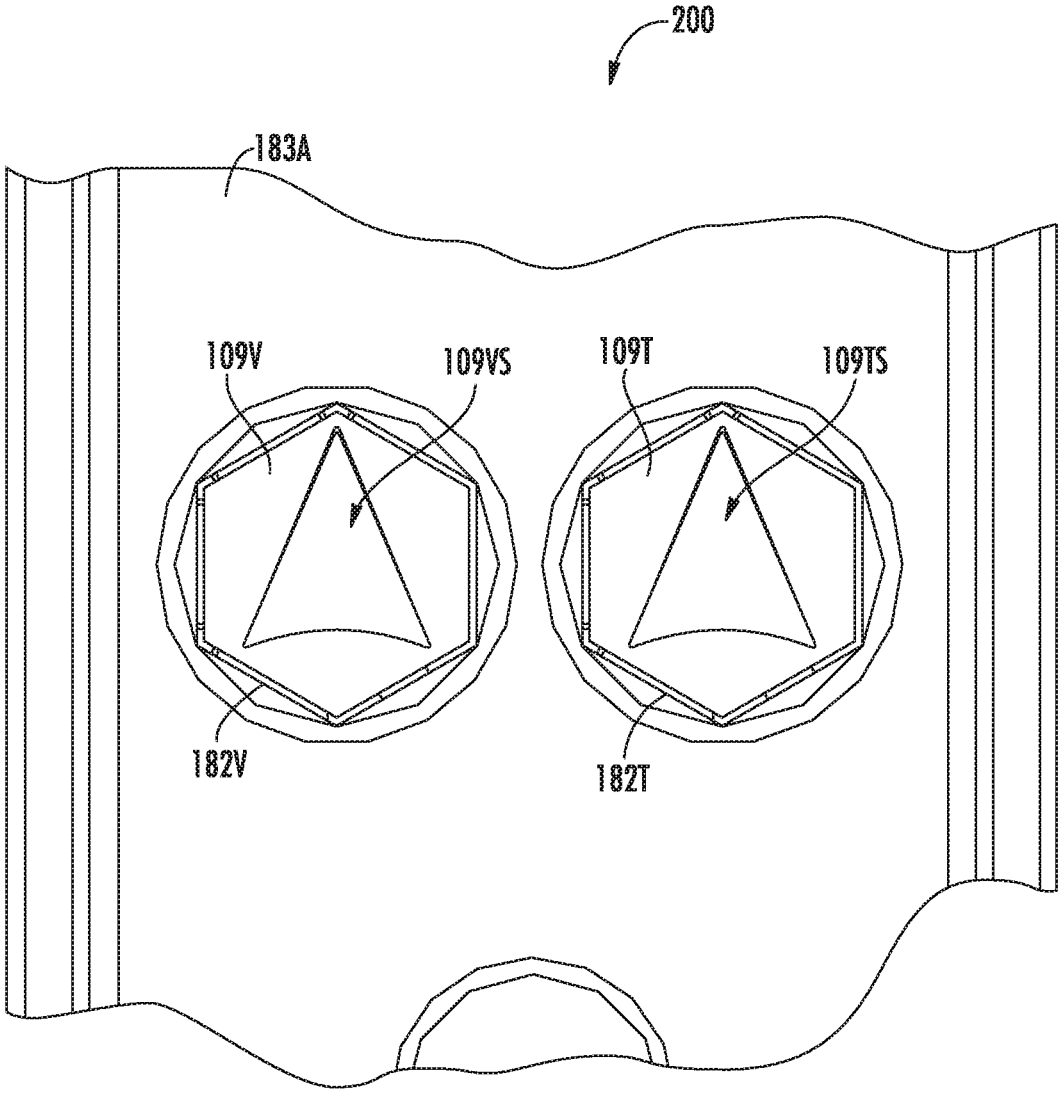
FIG. 16 is an enlarged, fragmentary, front view of the base of FIG. 12 showing designator sockets thereof.

With reference to FIG. 14, an exemplary electrical circuit 15 in which one or more SPD assemblies 101 may be used is shown therein. The SPD assemblies 101 may be mounted on a DIN rail 10 (FIG. 1). The illustrated circuit 15 is a three phase system using a "3+1" protection configuration. In the illustrated circuit 15, there are three SPD assemblies 101 (designated S1, S2, S3, respectively) each connected between a respective line L1, L2, L3 and N (i.e., L-N). An additional SPD module SPE is connected between N and PE (i.e., N-PE). The SPD module SPE may be connected to PE through a local ground terminal EBB (e.g., an equipotential bonding busbar). The SPD module SPE may also be an SPD assembly 101 as described herein. Each line L1, L2, L3 may be provided with a main circuit breaker or fuse FM and an external disconnector such as a supplemental fuse FS between the line and its SPD assembly S1, S2, S3. In other embodiments, one or more of the SPD assemblies S1, S2, S3, SPE may be of a different construction than the SPD assembly 101 as disclosed herein.

Operation of the SPD assembly S1 and conditions or transient overvoltage events on the line L1 will be described hereinbelow. However, it will be appreciated that this description likewise applies to the SPD assemblies S2, S3 and the lines L2, L3.

In case of a failure of the varistor 132, a fault current will be conducted between the corresponding line (e.g., Line L1 of FIG. 14) and the neutral line N. As is well known, a varistor has an innate nominal clamping voltage VNOM (sometimes referred to as the "breakdown voltage" or simply the "varistor voltage") at which the varistor begins to conduct current. Below the VNOM, the varistor will conduct practically no current. Above the VNOM, the varistor will conduct a current (i.e., a leakage current or a surge current). The VNOM of a varistor is typically specified as the measured voltage across the varistor with a DC current of 1 mA.

As is well known, a varistor has three modes of operation. In a first normal mode (discussed above), up to a nominal voltage, the varistor is practically an electrical insulator. In a second normal mode (also discussed above), when the varistor is subjected to an overvoltage, the varistor temporarily and reversibly becomes an electrical conductor during the overvoltage condition and returns to the first mode thereafter. In a third mode (the so-called end of life mode), the varistor is effectively depleted and becomes a permanent, non-reversible electrical conductor.

The varistor also has an innate clamping voltage VC (sometimes referred to as simply the "clamping voltage"). The clamping voltage VC is defined as the maximum voltage measured across the varistor when a specified current is applied to the varistor over time according to a standard protocol.

In the absence of an overvoltage condition, the varistor 132 provides high resistance such that approximately no current flows through the module 100 as it appears electrically as an open circuit. That is, ordinarily the varistor passes approximately no current. In the event of an overcurrent surge event (typically transient; e.g., lightning strike) or an overvoltage condition or event (typically longer in duration than an overcurrent surge event) exceeding VNOM, the resistance of the varistor wafer decreases rapidly, allowing current to flow through the module 100 and create a shunt path for current flow to protect other components of an associated electrical system. Normally, the varistor recovers from these events without significant overheating of the module 100.

Varistors have multiple failure modes. The failure modes include: 1) the varistor fails as a short circuit; and 2) the varistor fails as a linear resistance. The failure of the varistor to a short circuit or to a linear resistance may be caused by the conduction of a single or multiple surge currents of sufficient magnitude and duration or by a single or multiple continuous overvoltage events that will drive a sufficient current through the varistor.

A short circuit failure typically manifests as a localized pinhole or puncture site (herein, "the failure site") extending through the thickness of the varistor. This failure site creates a path for current flow between the two electrodes of a low resistance, but high enough to generate ohmic losses and cause overheating of the device even at low fault currents. Sufficiently large fault current through the varistor can melt the varistor in the region of the failure site and generate an electric arc.

A varistor failure as a linear resistance will cause the conduction of a limited current through the varistor that will result in a buildup of heat. This heat buildup may result in catastrophic thermal runaway and the device temperature may exceed a prescribed maximum temperature. For example, the maximum allowable temperature for the exterior surfaces of the device may be set by code or standard to prevent combustion of adjacent components. If the leakage current is not interrupted at a certain period of time, the overheating will result eventually in the failure of the varistor to a short circuit as defined above.

In some cases, the current through the failed varistor could also be limited by the power system itself (e.g., ground resistance in the system or in photo-voltaic (PV) power source applications where the fault current depends on the power generation capability of the system at the time of the failure) resulting in a progressive build up of temperature, even if the varistor failure is a short circuit. There are cases where there is a limited leakage current flow through the varistor due to extended in time overvoltage conditions due to power system failures, for example. These conditions may lead to temperature build up in the device, such as when the varistor has failed as a linear resistance and could possibly lead to the failure of the varistor either as a linear resistance or as a short circuit as described above.

As discussed above, in some cases the module 100 may assume an "end of life" mode in which a varistor 132 is depleted in full or in part (i.e., in an "end of life" state), leading to an end of life failure. When the varistor reaches its end of life, the module 100 will become substantially a short circuit with a very low but non-zero ohmic resistance. As a result, in an end of life condition, a fault current will continuously flow through the varistor even in the absence of an overvoltage condition.

In use, the base 200 is mounted on the DIN rail 10 as shown in FIG. 1. The DIN rail 10 is received in the channel 182F and secured by the hooks 182H and the latch mechanism 182G.

Cables 20, 22 (shown in dashed line in FIG. 1) are inserted through the cable ports 182C and secured in the clamp connectors 185A. In some embodiments, the cable 20 is connected to the line L1 and the cable 22 is connected to Protective Earth (PE)

The module 100 is then axially plugged or inserted into the receiver slot 183D in an insertion direction along the axis A-A through the front opening. The module 100 is pushed back into the receiver slot 183D until the rear end of the module 100 substantially engages the front side of the rear housing section 183A, as shown in FIG. 1.

Insertion of the module 100 into the slot 183D causes the terminals 166B and 168B to be inserted into the sockets 184B and 186B along an insertion axis I-I. Insertion of the module 100 into the slot 183D also causes the pins 106VP and 106TP to be inserted into the sockets 109VS and 109TS, respectively, as discussed in more detail below.

Because the thermal disconnector mechanism 140 is in its ready position, the indicator member 174 is held in a retracted position (FIGS. 8 and 9). Additionally, when the module 100 is inserted into the receiver slot 183D, the remote control pin 188A is thereby inserted into and extends through the port 122 but is depressed by the end 172G of the leg 172D that covers the port 122. The module 100 thereby provides feedback through the depressed remote control pin 188A that the module 100 has been seated in the base 200 and the module 100 is in its ready or operational (non-failed) condition.

The module 100 can be released and removed from the base 200 by executing a reverse of the foregoing procedure. The foregoing steps of mounting and removing the module 100 or other suitably configured modules in and from base 200 can be repeated multiple times. For example, in the event that the varistor 132 of the module 100 is degraded or destroyed or no longer of proper specification for the intended application, the module 100 can be replaced with a fresh or suitably constructed module.

The SPD assembly 101 has several modes of operation depending on the state of the varistor 132 and external event conditions.

In some modes, the first fail-safe mechanism 102 operates by heating the solder 148 until the solder melts and permits the elastic spring loads of the springs 150, 160 to cause the contact portion 154B to pull away from the heat sink member 142 and thereby out of electrical continuity with the electrode 136. The varistor 132 is thereby electrically disconnected from the contact member 168, creating an open circuit between the terminals 166B, 168B.

In some modes, the second fail-safe mechanism 104 operates by heating the spring 150 at the weak region 156 until the weak region is sufficiently heat-softened to permit the loads of the springs 150, 160 to cause the spring 150 to break at the weak region 156. The contact portion 154B may remain bonded to the heat sink member 142 by the solder 148, but the lower portion 154A pulls away from contact portion 154B and thereby out of electrical continuity with the electrode 136. The varistor 132 is thereby electrically disconnected from the contact member 168, creating an open circuit between the terminals 166B, 168B.

During normal operation (referred to herein as Mode 1), the module 100 operates as an open circuit between the neutral cable 20 and the PE cable 22. The thermal disconnector mechanism 140 remains in a ready position (FIGS. 8 and 9), with the contact portion 154B of the disconnect spring 150 bonded to and in electrical continuity with the heat sink member 142 by the solder 148. In this normal mode, the varistor 132 is an insulator up to the nominal clamping voltage VNOM (and therefore the SPD module 100 is an insulator as well). In this mode, the fail-safe mechanisms 102, 104 are not actuated (i.e., the thermal disconnector 140 remains in the ready position (FIGS. 8 and 9)).

In the event of a transient overvoltage or surge current in, the line L1, protection of power system load devices may necessitate providing a current path to ground for the excess current of the surge current. The surge current may generate a transient overvoltage between the line cable 20 and the PE cable 22, which may overcome the isolation of the varistor 132. In this event and mode (referred to herein as Mode 2), the varistor 132 is subjected to an overvoltage exceeding VNOM, and temporarily and reversibly becomes a low resistance electrical conductor. The varistor 132 will then divert, shunt or allow the high surge current or impulse current to flow from the line cable 20, through the contact member 166, through the connector 184, through the electrode 134, through the varistor 132, through the electrode 136, through the heat sink member 142, through the solder 148, through the springs 150, 160, through the contact member 168, through the connector 186 and to the protective earth cable 22 for a short duration.

In Mode 2, the fail-safe mechanism 102 does not operate because the overvoltage event is short in duration and the heat generated by the surge current is insufficient to melt the solder 148. The heat that is generated by the varistor 132 (e.g., from ohmic losses) is transferred to and absorbed or buffered in the heat sink element 142 and dissipated without raising the temperature of the solder 148 high enough to melt the solder 148 to the point where the bond between the spring 150 and the heat sink member 142 is broken. The heat sink member 142 may attenuate the heat transfer from the varistor 132 to the solder 148 so that the temperature of the solder 148 does not exceed the melting point of the solder 148. The heat sink member 142 may buffer the heat from the varistor 132. As used herein, buffering the heat means that the heat sink member 142 temporarily stores the heat. This allows the heat to be dissipated to the environment rather than to the solder 148. Further, the heat sink member 142 extends, lengthens or elongates the heat transfer path from the electrode 134 to the solder 148, thereby extending the time required to trip the spring 150 and enlarging the surface area for heat dissipation.

In Mode 2, the fail-safe mechanism 104 does not operate because the heat generated in the spring 150 is not sufficient to weaken the weak region 156 to the point of breaking.

If the surge or impulse current is below the maximum surge/impulse current that the SPD module 100 is rated for, the external fuse FS will not blow and the varistor 132 should remain functional. In this case, because the fail-safe mechanisms 102, 104 are not tripped, the SPD module 100 can remain in place for future overvoltage events.

If the surge or impulse current exceeds the maximum surge/impulse current that the SPD module 100 is rated for, the fuse FS will typically blow or be tripped. The varistor 132 may also fail internally as a short (with pinhole) or with limited resistance. In such cases, the mode of operations will be a failure mode as described below for Modes 3, 4 or 5.

In a third mode (Mode 3), the varistor 132 is in end of life mode with a low leakage current between the lines L1 and PE. The varistor 132 fails as a linear resistance. This type of varistor failure could be the result of multiple surge/impulse currents. The leakage current generates heat in the varistor 132 from ohmic losses. In some cases, the leakage current occurs during normal operation and is low (from about 0 to 0.5 A). The heat generated in the varistor 132 progressively deteriorates the varistor 132 and builds up over an extended duration.

Figure 10:
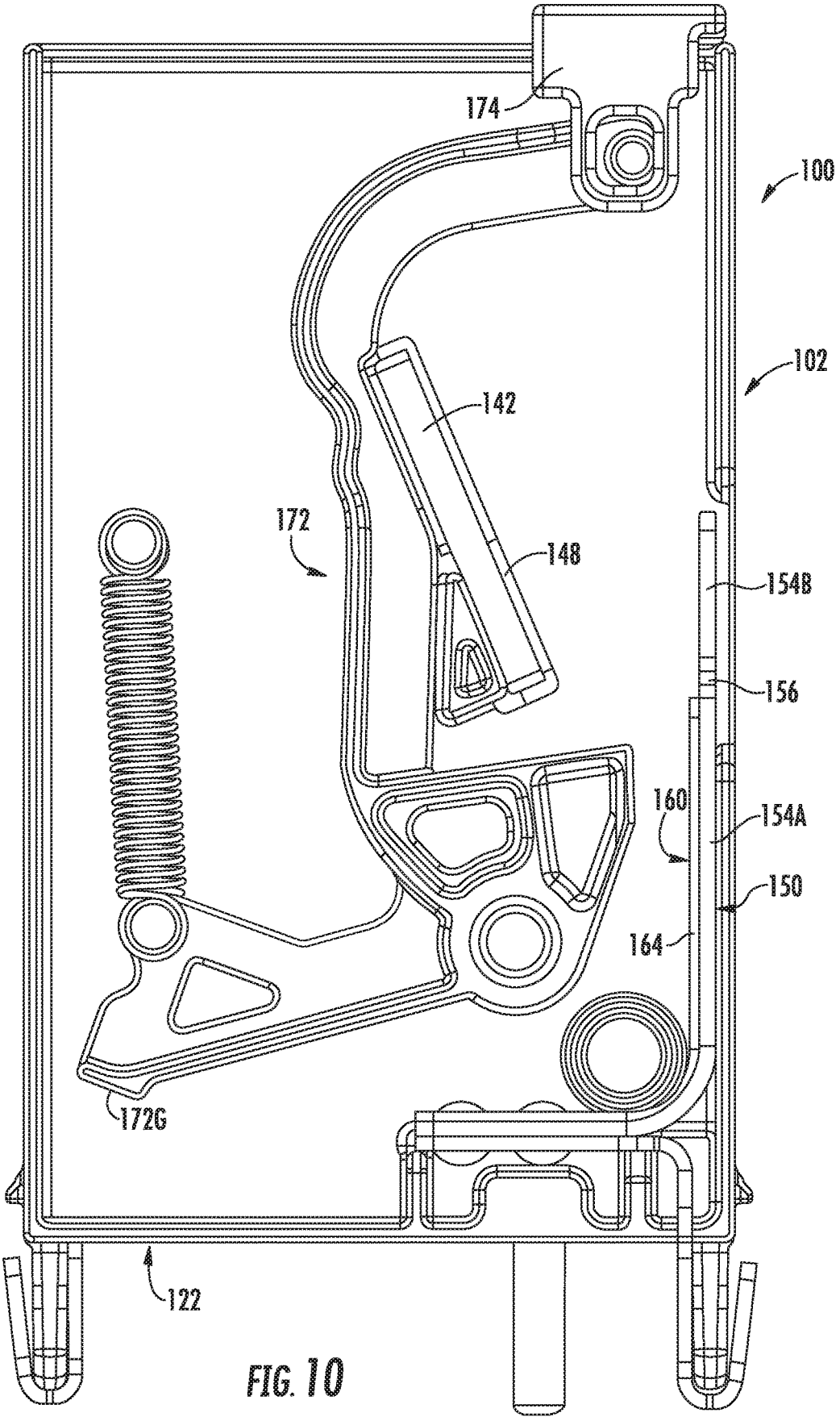
FIG. 10 is a right side view of the SPD module of FIG. 2 with the cover removed and the thermal disconnector mechanism thereof in a first tripped configuration.

In Mode 3, the fail-safe mechanism 102 operates. More particularly, the heat (e.g., from ohmic losses in the varistor 132) is transferred from the varistor 132 to the electrode 136, to the heat sink element 142, and then to the solder 148. Over an extended time period (e.g., in the range of from about 60 seconds to 48 hours), the heat builds up in the heat sink element 142 and the solder 148 until the solder 148 melts. The melted solder 148 releases the spring 150 into an open or released configuration to open the circuit in the SPD module 100 as shown in FIG. 10. The varistor 132 is thereby prevented from catastrophically overheating.

In Mode 3, the fail-safe mechanism 104 does not operate because the heat generated in the spring 150 is not sufficient to weaken the weak region 156 to the point of breaking.

In Mode 3, the SPD module 100 must be replaced because the fail-safe mechanism 102 has been tripped.

In a fourth mode (Mode 4), the varistor 132 is in good condition (i.e., not in end of life condition), but there is a Temporary Overvoltage (TOV) event wherein the voltage across the terminals 166B, 168B forces the varistor 132 to conduct an increased leakage current (typically, in the range of from about 0 to 10 A). This leakage current builds up heat over a duration (e.g., in the range of from about 5 seconds to 120 minutes) that is shorter than the duration of the leakage current that triggers the fail-safe mechanism 102 in Mode 3, but far longer than the impulse current that is conducted by the varistor 132 in Mode 2.

In Mode 4, the fail-safe mechanism 102 is tripped (i.e., the spring 150 is released by the solder 148) to open the circuit through the SPD module 100 as shown in FIG. 10 in the same manner as described for Mode 3.

In Mode 4, the fail-safe mechanism 104 does not operate because the heat generated in the spring 150 is not sufficient to weaken the weak region 156 to the point of breaking.

In Mode 4, the SPD module 100 must be replaced because the fail-safe mechanism 102 has been tripped.

In a fifth mode (Mode 5), the varistor 132 is in end of life mode as a short circuit or a linear resistance that allows current from the power source to be conducted therethrough. The value of the conducted current could be between about 10 Amps and the maximum short circuit current of the power source (which should be lower than the short circuit current rating of the SPD module 100). This depends on the specific configuration of the electrical installation and the severity of the varistor failure.

For Mode 5, there are two mechanisms operating to protect the SPD module 100: namely, the external fuse FS and the fail-safe mechanism 104 as described above. The fail-safe mechanism 104 is triggered for current levels between 10 Amps and intermediate current levels (typically five times the rating of the external fuse FS). For higher current levels, the external fuse FS will trip first to protect the SPD 100. For example, an SPD 100 could be protected by the fail-safe mechanism 104 for current levels up to 1000 A and with a 200 A external fuse FS for current levels up to 25 kA.

In Mode 5, for intermediate currents, the current level is not high enough to trip the external fuse FS within a reasonable amount of time (e.g., in the range of from about 50 ms to 5000 ms). Further, the fail-safe mechanism 102 is too slow and cannot protect the SPD module 100. By the time the fail-safe mechanism 102 trips, there would be significant internal damage to the SPD module 100.

Figure 11:
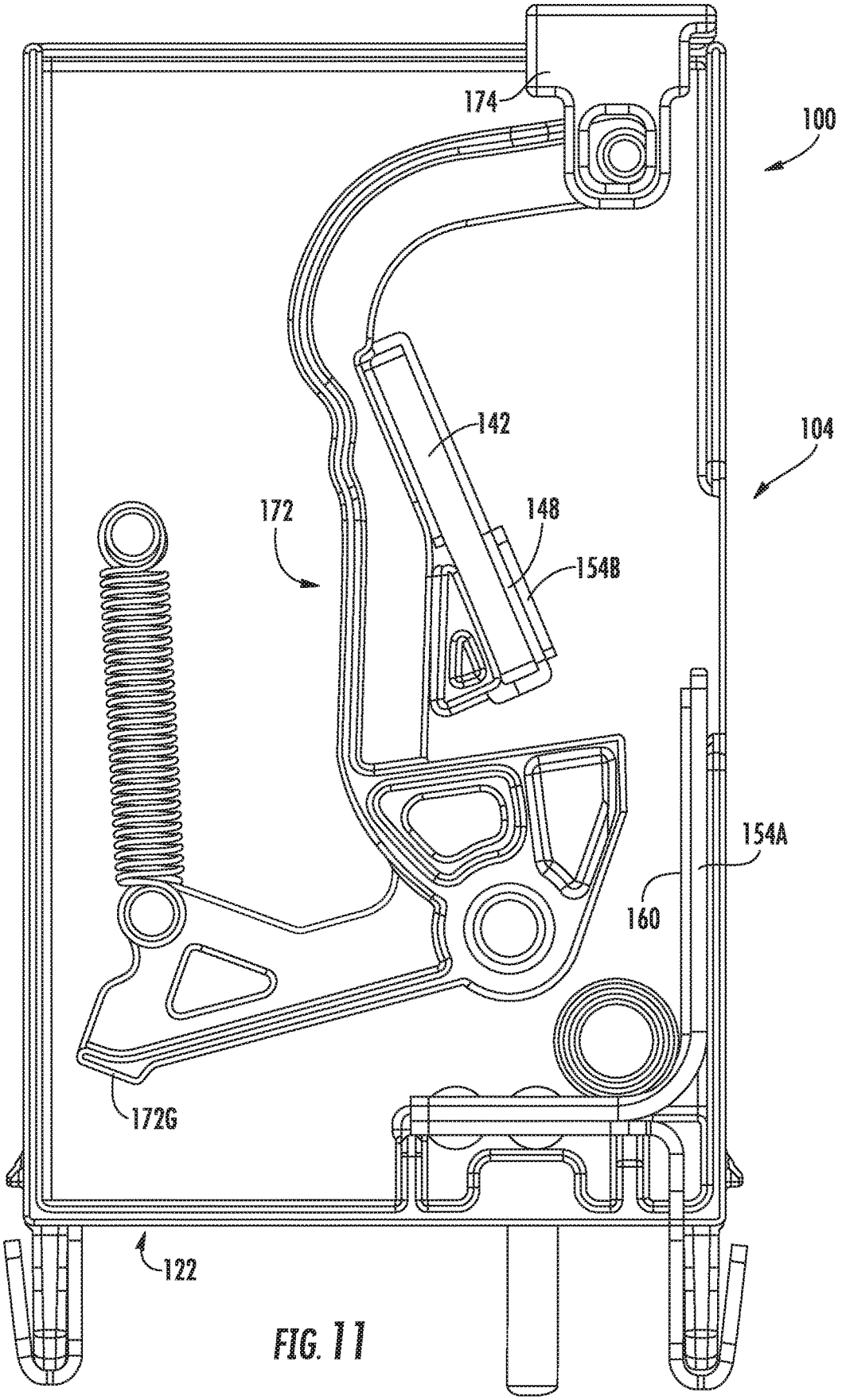
FIG. 11 is a right side view of the SPD module of FIG. 2 with the cover removed and the thermal disconnector mechanism thereof in a second tripped configuration.
Figure 12:
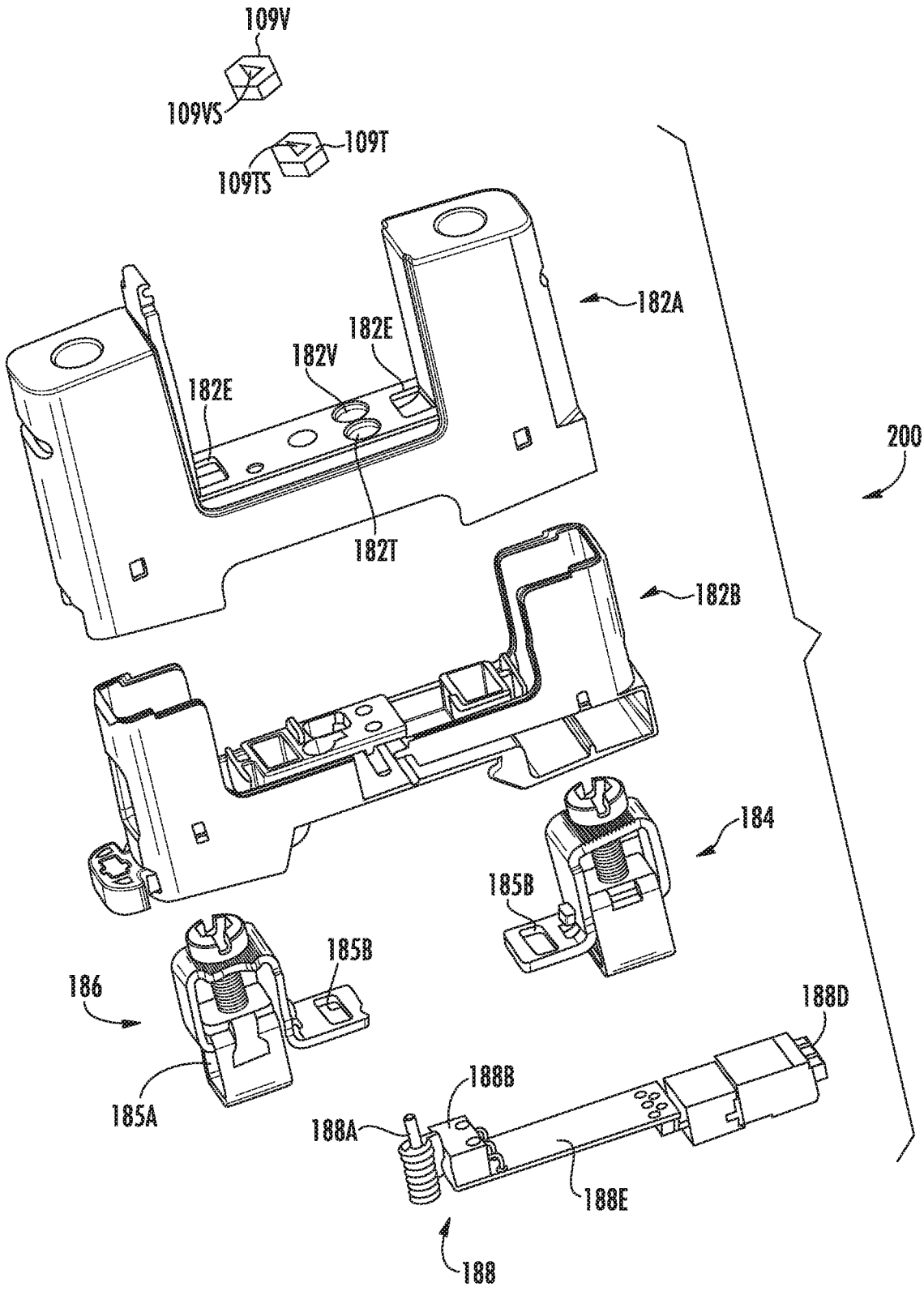
FIG. 12 is an exploded, front, bottom, right perspective view of a base assembly forming a part of the SPD assembly of FIG. 1.
Figure 13:
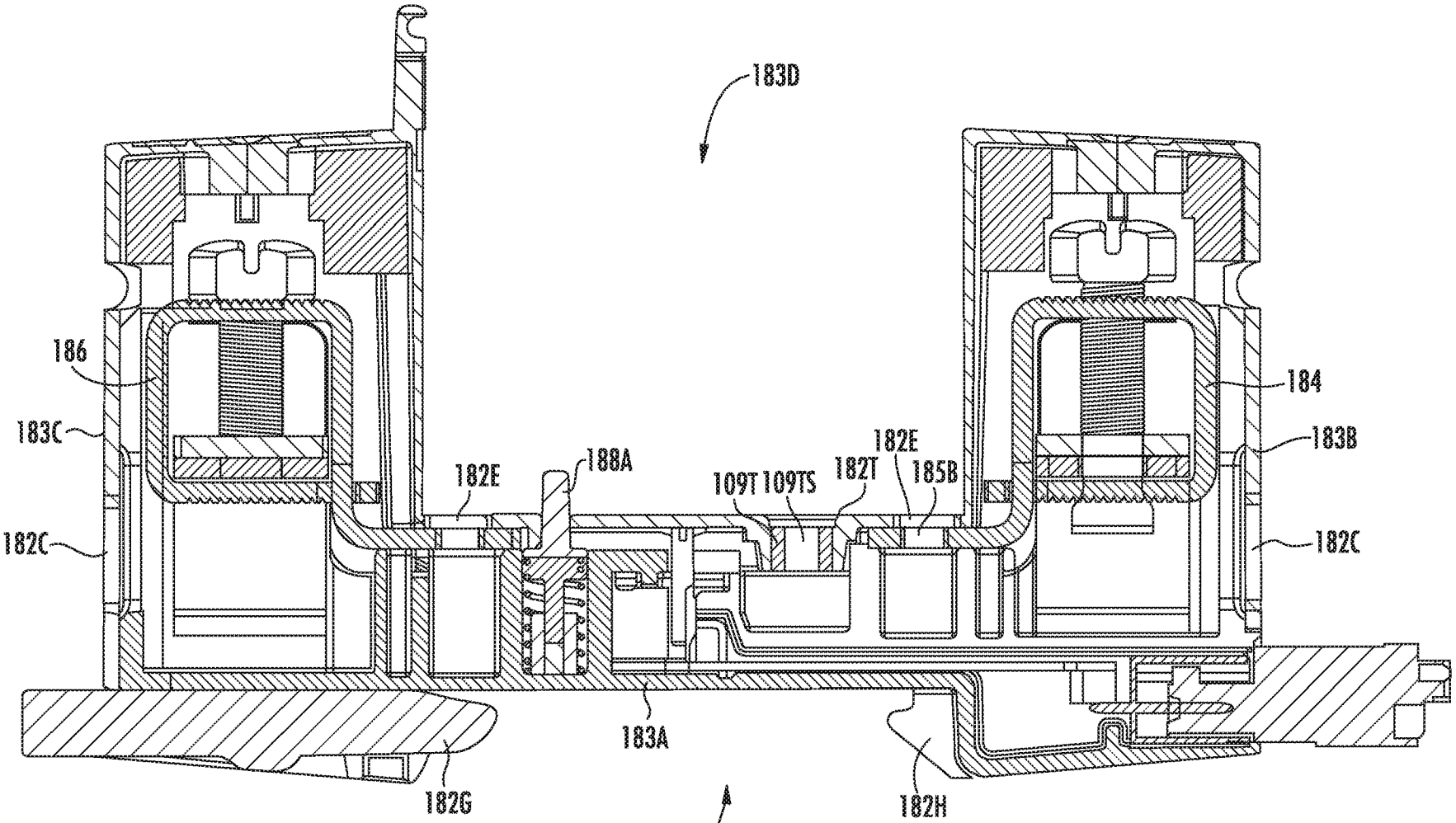
FIG. 13 is a cross-sectional view of the base assembly of FIG. 12 taken along the line 13-13 of FIG. 1.

Therefore, in Mode 5, the fail-safe mechanism 104 is tripped to open the circuit through the SPD module 100 as shown in FIG. 11. More particularly, the current heats the spring 150 at the weak region 156 until the loads of the springs 150, 160 cause the spring 150 to break at the weak region 156 and produce the necessary distance between the electrodes for extinguishing the associated arc. The spring 150 will disproportionately head and weaken at the weak region 156 because the electrically conductive cross-sectional area at the weak region 156 is less than that of the remainder of the spring 150, because the electrically conductive cross-sectional area of the remainder of the spring 150 is effectively supplemented by the heat sink member 142 and the supplemental spring 160, and because the other remainder of the spring 156 is cooled by the supplemental spring 160 and the heat sink member 142, which serve as heat sinks. The varistor 132 is thereby electrically disconnected from the contact member 168, creating an open circuit between the terminals 166B, 168B. Only the fail-safe mechanism 104 operates in time and disconnects the SPD 100 before any internal damage tales place.

Alternatively, a lower rated fuse FS could be used so that the fuse FS will trip much faster and protect the SPD 100 even at intermediate current levels. For example, a 10A fuse FS could be used and the fail-safe mechanism 104 could be omitted. But then, such a lower rated fuse FS would trip at surge/impulse currents below the level that the SPD 100 could actually withstand. Therefore, by using the fail-safe mechanism 104, the performance of the SPD 100 is extended in surge/impulse currents.

The release of the disconnect spring 150 as described above (by actuation of the fail-safe mechanism 102 or the fail-safe mechanism 104) also actuates a local alert mechanism 107. The displacement of the springs 150, 160 in the release direction DR frees the swingarm leg 172B from the springs 150, 160. The swingarm 172 is driven in a pivot direction DP (FIG. 9) by the spring 176 from the locked position (FIGS. 7-9) to an indicating position (FIGS. 10 and 11). The indicator member 174 is thereby driven by the spring 176 to slide along the rail 116B in a signaling direction DS (FIG. 9). The indicator member 174 is thereby displaced to an alert position as shown in FIG. 10 or 11 wherein the indicator surface 174A is aligned with and visible through the front window 112B of the module housing 110. The indicator surface 174A has a noticeably different visual appearance through the front window 112B than the housing indicator surface 116C, providing a visual alert or indication so that an operator can readily determine that the local alert mechanism 107 has been activated. For example, the housing indicator surface 116C and the indicator surface 174A may have distinctly different colors (e.g., green versus red). In this manner, the local alert mechanism 107 can provide a convenient indication that the module 100 has assumed its open circuit configuration or state.

The release of the swingarm 172 as described above also actuates the remote alert mechanism 170B. In the ready position of the module 100, an end 172G of the switch leg 172D covers the rear opening 122 so that the switch pin 188A of the base 200 is maintained compressed. When the swingarm 172 pivots into the indicating position, the switch leg 172D moves away from the rear opening 122 so that the rear port 122 is no longer covered. The switch pin 188A is thereby permitted to extend further into the module 100 through the opening 122 to an alert signal position. The remote pin 188A is connected to the switch electronics 188B or sensor, which detects the displacement of the pin 188A and provides an electrical signal to a remote device or terminal via the connector 188D. In this manner, the remote alert mechanism 170B can provide a convenient remote indication that the module 100 has assumed its open circuit configuration or state.

As discussed above, the thermal disconnector mechanism 140 is responsive to temperature rise in the SPD module 100 when current flows through the varistor 132, and disconnects the varistor 132 from the power line. In general, the thermal disconnector mechanism 140 may be configured to desirably balance the response of the SPD assembly 100 and the fuse FS to impulse or surge currents versus leakage currents. The failure mode of the varistor 132 could be one of the modes discussed above, for example: progressive deterioration of the varistor 132 that will result in increased leakage current at normal operation (e.g., 0-0.5 A); temporary overvoltage (TOV) events that will result in an increased conduction of leakage current (e.g., 0.5 A-10 A); or a short circuit of the varistor 132 that may result in a significant current conduction (a few amps up to the full prospective short circuit current of the power line, e.g., up to 200 kArms).

When the varistor 132 has an increased leakage current conduction (Modes 3 and 4 discussed above), then the varistor 132 will progressively overheat over an extended period of time. Eventually, the thermal disconnector mechanism 140 will then react to the temperature rise of the varistor 132 that is transferred to the soldering joint J2 through the electrode tab 138 and the heat sink member 142. How fast the thermal disconnector mechanism 140 will react to this event on a given temperature profile of the varistor 132 depends on the materials of the components of the thermal disconnector mechanism 140, the melting point of the solder 148 and the mass and shape of the heat sink member 142. These parameters, including the thermal capacity of the heat sink member 142, can be selected to tune the response of the thermal disconnector mechanism 140 to different event profiles or types of events.

Further, the reaction time of the thermal disconnector mechanism 140 should not be too fast, because in cases where the varistor 132 conducts surge currents of increased energy, the varistor 132 will overheat and the disconnector mechanism 140 might trip, even though the varistor 132 is intact. Therefore, it is desirable or necessary to fine tune the reaction time of the thermal disconnector mechanism 140. Therefore, the selection of the material and shape of the elements that constitute the thermal disconnector mechanism 140 are important, and may be critical, for proper operation during all kinds of events/exposures the SPD module 100 might face, as the reaction time depends on this selection.

During sudden failure of the varistor 132 to a short circuit, the current through the varistor 132 could reach from intermediate values (a few kA) up to the maximum short circuit current of the power line. For intermediate values of current, typically the weak point 156 of the thermal disconnector will overheat first, melt and disconnect the current via the second fail-safe mechanism 104. This is done because the weak point 156 of the thermal disconnector mechanism 140 has a decreased cross section area of higher resistance. Also the selection of the material of the weak region 156 is important for its fast reaction time, as in such events the second fail-safe mechanism 104 of the thermal disconnector mechanism 140 must react very fast. The second fail-safe mechanism 104 is not responsive to surge currents, so there is no low limit for its response time. In addition, if the second fail-safe mechanism 104 does not react fast enough, the SPD module 100 may be damaged due to the high current conducted. Further, during these events there will be no melting of the solder 148, as the first fail-safe mechanism 102 takes a relatively long time to react (seconds), while the second fail-safe mechanism 104 executes more quickly and the weak point 156 will melt in milliseconds (ms).

When the short circuit current is high enough, then the SPD module 100 is protected by an external fuse FS. In general, the external fuse FS will trip when the short circuit current is sufficient to trip when the fuse FS. The thermal disconnector mechanism 140 (either the first fail-safe mechanism 102 or the second fail-safe mechanism 104) will trip when the short circuit current is insufficient to trip the fuse FS.

As discussed above, it is desirable for the solder 148 to not melt and not release the spring 150 in response to a Mode 2 or Mode 5 event. In the absence of the heat sink member 142, it would be necessary to use a solder 148 having a relatively high melting point to prevent the solder 148 from melting and releasing the spring 150 in response to a Mode 2 event. This is because the heat (thermal energy) generated in the varistor 132 would be relatively quickly transferred (conducted) to the solder 148 via the electrode tab 138 with relatively little time and surface area to dissipate the heat, thereby raising the solder 148 above its melting point.

However, because the heat sink member 142 is provided between the varistor 132 and the solder 148, the heat from the varistor 132 is absorbed and buffered in the heat sink member 132, which provides thermal capacitance. Because the heat sink member 142 has a substantially greater thermal capacity than the electrode tab 138, the temperature of the heat sink member 142 is increased substantially less than the electrode tab 138 alone would be in response to the heat transferred from the varistor 132. A portion of this heat is in turn transferred to the solder 148 and a portion is dissipated (e.g., by radiation and convection) to the ambient air over time. As a result, the electrode 136 is permitted to cool and the temperature of the solder 148 does not exceed the solder melting point as a result of the Mode 2 event. That is, while the heat generation profile of the varistor 132 remains the same, the profile of the heat transfer to the solder 148 and the temperature profile of the solder 148 are attenuated or damped so that the temperature of the solder 148 is maintained below its melting point. The heat sink member 142 thereby serves to regulate the thermal transfer from the varistor 132 to the solder 148.

On the other hand, it is desirable for the solder 148 to melt and release the spring 150 in response to a Mode 3 or Mode 4 event. Because the heat transfer to the solder 148 is attenuated by the heat sink member 142 as discussed above, a solder 148 can be used that has a lower melting point without risk that the first fail-safe mechanism 102 will be tripped by a Mode 2 event. The use of a lower melting point soldier 148 may be advantageous because it enables the first fail-safe mechanism 102 to actuate at a lower prescribed temperature of the SPD module 100, and thereby prevent the SPD module 100 from further overheating.

In some embodiments and as shown, the heat sink member 142 is a discrete component, separately formed from and secured to the electrode tab 138. This construction can provide several advantages.

In some cases, it may be desirable to form the heat sink member 142 of a different material than the electrode tab 138. For example, it may be desirable to form the heat sink member 142 of a first material that bonds well with the solder 148 and has preferred thermal performance (e.g., a greater specific heat capacity than the material of the solder 148), and to form the electrode tab 138 of a second material that is less expensive or otherwise better suited for forming the electrode 136. By forming the heat sink member 142 and the electrode tab 138 as separate components, the heat sink member 142 and the electrode tab 138 can be formed of different materials from one another and of materials best suited for their respective functions.

Forming the heat sink member 142 as a discrete component can make the module 100 easier and/or less expensive to manufacture. For example, the heat sink member 142 can provide the required thermal mass and capacity while permitting the electrode tab 138 to be unitarily formed (e.g., by stamping and bending a metal sheet) with the remainder of the electrode 136.

The discrete heat sink member 142 can provide flexibility in design of the SPD module 100. Heat sink members 142 of different dimensions and materials can be selected depending on the desired performance characteristics of the module 100. For example, if it is desired to provide a greater time delay for actuation of the first fail-safe mechanism 102 by buffering more heat from the varistor 132 in the heat sink member 142, a heat sink member 142 having a larger thermal capacity and/or dissipating surface area may be used.

The integral electrode tab reinforcement feature or post 124 mechanically supports or reinforces the electrode tab 138, the heat sink member 142 and the spring contact portion 154B to resist deformation or deflection of these components that may jeopardize the solder joint J2. Absent the feature 124, such deformation or deflection may be induced by electrodynamic loads generated on the electrode 136 by surge currents.

The shapes of the electrodes 134, 136 can provide good electrical contact between the electrodes 134, 136 and the metallization layers 133 while minimizing the required material. The electrodes 134, 136 can accommodate and effectively cover and contact MOVs having a range of sizes (e.g., 75V to 880V). The diagonal cross-legs 134B, 136B can resist deformation or deflection in the electrodes 134, 136 and the varistor 132 induced by electrodynamic loads generated on the electrode 136 by surge currents. In particular, the cross-leg 136B can resist rotation or other relative displacement of the electrode tab 138.

In some embodiments, the heat sink member 142 is secured to the electrode tab 138 by a plurality of attachment points. For example, in the illustrated embodiment, the heat sink member 142 is secured to the electrode tab 138 by two rivets 144. The multiple points of attachment can resist relative displacement between the heat sink member 142 and the tab 138, which may otherwise be induced by electrodynamic loads generated on the electrode 136 by surge currents.

The supplemental spring 160 serves as a heat sink element to provide cooling of the disconnect spring 150 when high current flows through the springs 150, 160. The spring 160 also increases the short circuit capability of the SPD module 100. The spring 160 provides additional deflection force on the spring 150 (and, thereby, the weak region 156 and the solder joint J2). Because the spring 160 terminates below the weak region 156, the spring 160 does not increase the effective cross-sectional area of the weak region 156.

Because the supplemental spring 160 is a discrete component separately formed from the disconnect spring 150, the springs 150 and 160 can each be formed of materials and dimensions best suited for their respective functions. Also, the SPD module 100 can be more cost-effectively manufactured.

In some embodiments, the springs 150, 160 together exert a spring force on the solder 148 in the range of from about 0.5 N to 1.5 N when the disconnect mechanism 140 is in the ready position.

In some embodiments, the module 100 is a Class I surge protective device (SPD). In some embodiments, the module 100 is compliant with IEC 61643-11 "Additional duty test for test Class I" for SPDs (Clause 8.3.4.4) based on the impulse discharge current waveform defined in Clause 8.1.1 of IEC 61643-11, typically referred to as 10/350 microsecond ("μs") current waveform ("10/350 μs current waveform"). The 10/350 μs current waveform may characterize a current wave in which the maximum current (100%) is reached at about 10 μs and the current is 50% of the maximum at about 350 μs. Under 10/350 μs current waveform, the transferred charge, Q, and specific energy, W/R, to SPDs should be related with peak current according to one or more standards. For example, the IEC 61643-11 parameters to Class I SPD test are illustrated in Table 1, which follows:

TABLE 1

Parameters for Class I SPD Test

| $I_{imp}$ within 50 μs (kA) | Q within 5 ms (As) | W/R within 5 ms (kJ/Ω) |
|---|---|---|
| 25 | 12.5 | 156 |
| 20 | 10 | 100 |
| 12.5 | 6.25 | 39 |
| 10 | 5 | 25 |
| 5 | 2.5 | 6.25 |
| 2 | 1 | 1 |
| 1 | 0.5 | 0.25 |

It is desirable that the SPD modules have a small form factor. In particular, in some applications it is desirable that the SPD modules each have a size of 1TE according to DIN Standard 43871, published Nov. 1, 1992. According to some embodiments, the module 100 has a maximum width W9 (FIG. 1) parallel to the axis F1-F1 of about 18 mm.

Modules including fail-safe mechanisms, alarm mechanisms and connector systems as disclosed herein may include an overvoltage clamping element of a different type in place of the varistor 132. The overvoltage clamping element may be a transient voltage suppressor (TVS) such as a TVS-diode (e.g., a silicon avalanche diode (SAD)).

As discussed above, in some embodiments the springs 150, 160 are formed of metal and, in some embodiments, are formed of CuSn 0.15. By using metal springs 150, 160, the reliability and, thus, safety of the SPD module 100 is improved because the module 100 does not rely on operation of a plastic part (which could melt or jam) to push the thermal disconnector mechanism 140 into the open position.

A metal spring 150, 160 can maintain its spring force at a much higher temperature than a plastic spring. Moreover, a CuSn 0.15 spring can maintain its spring force or characteristics at a much higher temperature (e.g., up to 400° C.) than springs formed of other typical spring copper materials (e.g., Cu/ETP) that lose their spring characteristics at about 200° C.

With reference to FIGS. 8, 12, 13, 15 and 16, the SPD system 103 may further employ a designator system to ensure that the SPD module and base are properly matched. The designator system includes the pin inserts 106V, 106T and the socket inserts 109V, 109T.

The pin insert 106V includes a pin 106VP and an integral base 106VB. The base 106VB is axially and rotationally fixed in position in the socket 105V. The pin insert 106T likewise includes a pin 106TP and an integral base 106TB fixed in the socket 105T. In some embodiments and as shown, the bases 106VB, 106VT and the sockets 105V, 105T have complementary geometric shapes (e.g., faceted hexagonal). In some embodiments and as shown, the pin inserts 106V, 106T are substantially identical.

Each pin 106VP, 106TP has a rotationally asymmetric cross-sectional shape. In some embodiments, the cross-sectional shape is generally a non-equilateral triangle.

The socket inserts 109V, 109T each include a respective base or body 109VB, 109TB and a respective socket 109VS, 109TS defined therein. The bases 109VB and 109TB are axially and rotationally fixed in the sockets 182V and 182T, respectively. In some embodiments and as shown, the bases 109VB, 109TB and the sockets 182V, 182T have complementary geometric shapes (e.g., faceted hexagonal). In some embodiments and as shown, the socket inserts 109V, 109T are substantially identical.

The socket 109VS has a rotationally asymmetric cross-sectional shape that is shaped to receive the pin 106VP in a single relative rotational orientation. Likewise, the socket 109TS has a rotationally asymmetric cross-sectional shape that is shaped to receive the pin 106TP in a single relative rotational orientation. In some embodiments, the shapes of the sockets 109VS, 109TS are non-equilateral triangles.

Each base 200 will have two prescribed, designated characteristics:

1) a Maximum Continuous Operating Voltage Level (MCOV Level). For example, a given base 200 may be designed, adapted or rated for a nominal voltage of 120V AC and an MCOV Level of 150V, while another base 200 is rated for a nominal voltage of 240V AC and an MCOV Level of 300V. The MCOV Level of a given base 200 may be a function of the characteristics (e.g., VNOM) of its varistor 132; and
2) a Type. For example, each base may be designed, adapted or rated for exactly one of AC or DC or neutral-protective earth (N-PE) or a Special Proprietary Technology. Each module 100 will likewise have the same two prescribed, designated characteristics (i.e., MCOV Level and Type).

The pin 106VP serves as a voltage designation pin. The socket 109VS serves as a voltage designator socket. The pin 106TP serves as a type designator pin. The socket 109TS serves as a type designator socket.

The pin 106VP is rotationally oriented in a prescribed position corresponding to the designated MCOV Level of the module 100. The socket 109VP is likewise rotationally oriented in a prescribed position corresponding to the MCOV Level of the base 200. The pin 106TP is rotationally oriented in a prescribed position corresponding to the Type of the module 100. The socket 109TS is rotationally oriented in a prescribed position corresponding to the Type of the base 200.

In practice, a complete SPD system 103 and SPD assembly 101 will include a base 200 and a matching (MCOV Level and Type) module 100. The rotational orientations of the pins 106VP, 106TP and the sockets 109VS, 109TS are set so that the pin 106VP can be easily inserted into the socket 109VS and the pin 106TP can be easily inserted into the socket 109TS as the module 100 is inserted into the receiver slot 183D and the contacts 166A, 168A are inserted into the sockets 185B.

When the SPD module 100 fails, the user may unplug the module 100 from the base 200 and plug a new module 100 into the base 200 since, in most cases, the base 200 is still intact and functional and it is not necessary to replace the base 200. The new module 100 must be of the same MCOV Level and Type as the "old" (existing) base 200. If the new module 100 is of the same MCOV Level and Type, its pins 106VP, 106TP will be rotationally oriented in the same, correct positions to match the rotational orientations of the sockets 109VS, 109TS, thereby permitting the new module 100 to be inserted into the receiver slot 183D and the contacts 166A, 168A to be inserted into the sockets 185B.

On the other hand, if the user (or the manufacturer) attempts to insert a module 100 having a different MCOV Level and/or Type than the base 200, one or both of the pins 106VP, 106TP will prevent full insertion of the module 100 into the receiver slot 183D sufficient to insert the contacts 166A, 168A into the sockets 185B because the rotational orientation mismatch (i.e., relatively displaced rotational orientations) between the pin 106VP and the socket 109VS and/or between pin 106TP and the socket 109TS will block or prevent insertion of the pin(s) 106VP, 106TP into the socket(s) 109VS, 109TS. Thus, a module 100 with an MCOV Level of 150V cannot be installed on a base 200 with a 300V MCOV Level. Similarly, a module 100 with a Type of AC cannot be installed on a base 200 with a DC Type.

In some embodiments and as mentioned above, the pin inserts 106VP, 106TP are identical and the socket inserts 109VS, 109TS are substantially identical so that it is only necessary to manufacture one shape of pin insert and one shape of socket insert. The pins and sockets are then differentiated and set in their appropriate prescribed orientations (corresponding to the MCOV Level and Type of the associated module or base) by selecting the rotational positions of the pin inserts 106V, 106T in the sockets 105V, 105T and selecting the rotational positions of the socket inserts 109V, 109T in the sockets 182V, 182T. It will be appreciated that in the illustrated embodiment, as many as six different positions are possible for each insert in the hexagonal sockets.

Figure 17:
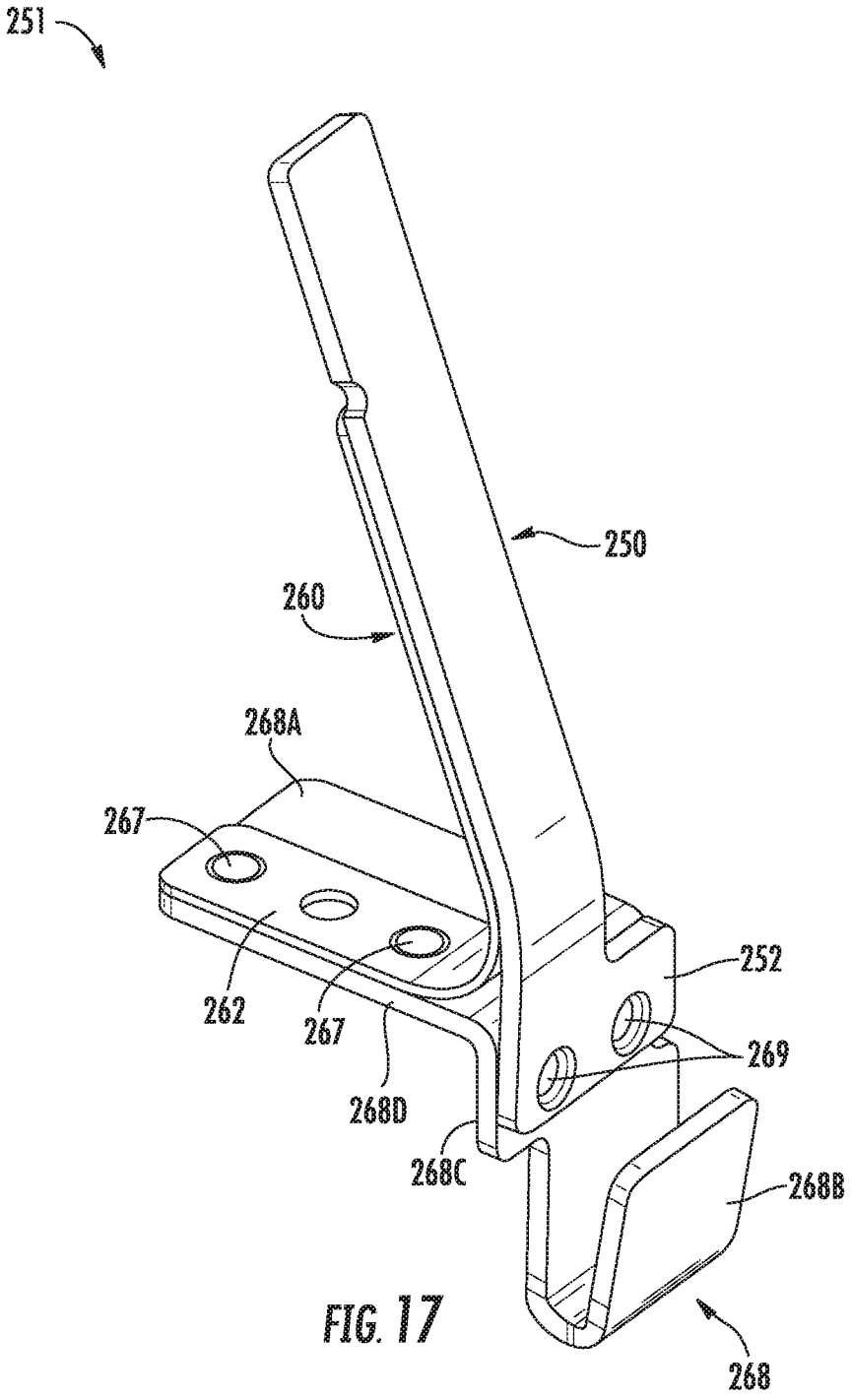
FIG. 17 is a perspective view of a spring/contact assembly according to further embodiments of the invention.
Figure 18:
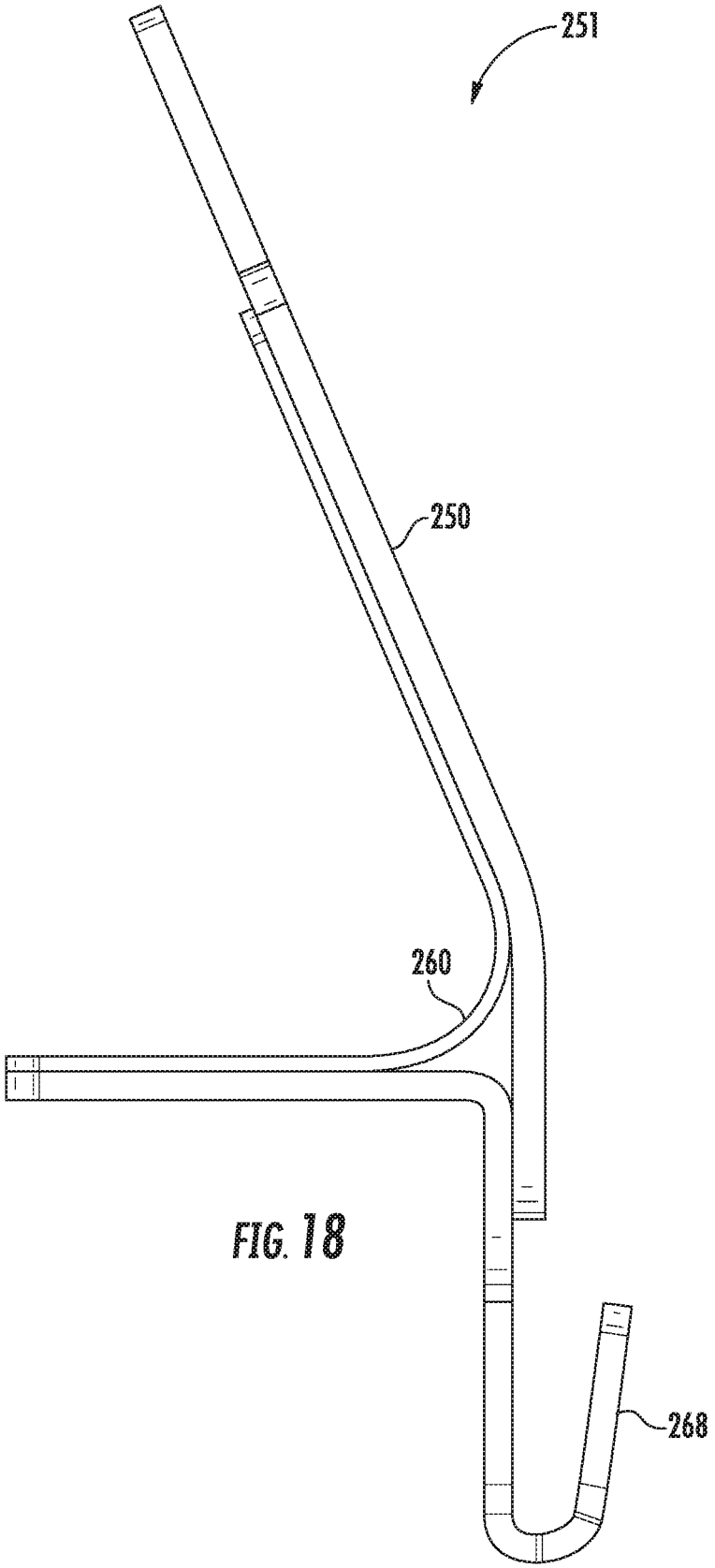
FIG. 18 is a side view of the spring/contact assembly of FIG. 17.

With reference to FIGS. 17 and 18, a spring/contact assembly 251 according to further embodiments of the invention is shown therein. The spring/contact assembly 251 may be used in place of the spring/contact assembly 151 in the SPD module 100.

The spring/contact assembly 251 includes a second contact member 268, a disconnect spring 250 and a supplemental spring 260 generally corresponding to the second contact member 168, the spring 150, and the spring 160, respectively. The spring 250 differs from the spring 150 in that the spring 250 includes a base leg 252 that extends rearwardly instead of laterally.

The second electrical contact member 268 includes a base 268A and an integral U-shaped terminal connector 268B. The base leg 262 of the supplemental spring 260 is secured to a front section 268D of the base 268A by TOX rivets or clinching joints 267. The base leg 252 of the disconnect spring 250 is secured to a leg 268C of the base 268A by TOX rivets or clinching joints 269. The springs 250, 260 and the contact member 268 thus assembled collectively form the spring/contact subassembly 251.

The spring/contact assembly 251 may be less expensive to manufacture than the spring/contact assembly 151.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed is:

1. A surge protective device (SPD) module comprising:
- a module housing;
- first and second module electrical terminals mounted on the module housing;
- an overvoltage clamping element electrically connected between the first and second module electrical terminals; and
- a thermal disconnector mechanism positioned in a ready configuration, wherein the overvoltage clamping element is electrically connected with the second module electrical terminal, the thermal disconnector mechanism being repositionable to electrically disconnect the overvoltage clamping element from the second module electrical terminal, the thermal disconnector mechanism including:
  - an electrode electrically connected to the overvoltage clamping element;
  - a disconnect spring elastically deflected and electrically connected to the electrode in the ready configuration;
  - a solder securing the disconnect spring in electrical connection with the electrode in the ready configuration; and
  - a heat sink member located between the electrode and the solder and thermally interposed between the electrode and the solder, the heat sink member having a thermal capacity;
- wherein the solder is meltable in response to overheating of the overvoltage clamping element;
- wherein the disconnect spring is configured to electrically disconnect the overvoltage clamping element from the second module electrical terminal when the solder is melted; and
- wherein the thermal capacity of the heat sink member buffers and dissipates heat from the overvoltage clamping element to prevent the solder from melting in response to at least some surge currents through the SPD module.

2. The SPD module of claim 1 wherein the electrode, the heat sink member, and the disconnect spring are each separate and discrete components from one another.

3. The SPD module of claim 1 wherein the solder directly engages both the heat sink member and the disconnect spring.

4. The SPD module of claim 1 wherein:
- the heat sink member is formed of a first material; and
- the electrode is formed of a second material that is different from the first material.

5. The SPD module of claim 4 wherein the first material has a greater specific heat capacity than the second material.

6. The SPD module of claim 1 wherein the thermal capacity of the heat sink member is in the range of from about 0.2 to 2.0 J/K.

7. The SPD module of claim 1 wherein the thermal capacity of the heat sink member is at least about 0.15 times a thermal capacity of the electrode.

8. The SPD module of claim 1 wherein the overvoltage clamping element is a varistor.

9. The SPD module of claim 1 wherein:
- the heat sink member is affixed to the electrode such that the heat sink member remains affixed to the electrode when the solder has melted and the disconnect spring has electrically disconnected the overvoltage clamping element from the second module electrical terminal; and
- the solder directly engages the heat sink member.

10. The SPD module of claim 9 wherein the heat sink member is affixed to the electrode by rivets.

11. The SPD module of claim 1 wherein the electrode includes:
- a base portion engaging the overvoltage clamping element; and
- an integral upstanding termination tab connecting the base portion to the heat sink member.

12. The SPD module of claim 1 wherein:
- the SPD module includes a support frame; and
- the support frame includes an integral support feature configured to resist displacement of the heat sink member relative to the disconnect spring.

13. The SPD module of claim 1 including a supplemental spring, wherein, in the ready configuration, the supplemental spring:
- is electrically connected to the electrode;
- applies a spring load to the disconnect spring; and
- provides thermal capacity to cool the disconnect spring.

14. The SPD module of claim 1 wherein the disconnect spring is formed of a material having a softening temperature greater than 300° C.

15. The SPD module of claim 1 including a contact member, wherein:
- the contact member includes the second module terminal; and
- the disconnect spring is affixed to the contact member.

16. The SPD module of claim 15 wherein the disconnect spring is affixed to the contact member by clinching.

17. The SPD module of claim 1 including an indicator mechanism configured to provide an alert that the SPD module has failed when the thermal disconnector mechanism disconnects the overvoltage clamping element from the second module electrical terminal.

18. The SPD module of claim 17 wherein the indicator mechanism includes a local alert mechanism including:
- a window in the module housing;
- an indicator member movable between a ready position and an indicating position relative to the window; and
- an indicator spring configured to force the indicator member from the ready position to the indicating position when the thermal disconnector mechanism disconnects the overvoltage clamping element from the second module electrical terminal.

19. The SPD module of claim 17 wherein the indicator mechanism includes a remote alert mechanism including:

a switch opening in the module housing to receive a switch pin from an external base assembly;

a blocking member covering the switch opening; and an indicator spring configured to force the blocking member away from the switch opening when the thermal disconnector mechanism disconnects the overvoltage clamping element from the second module electrical terminal to permit the switch pin to extend through the switch opening.

* * * * *